US008120601B2

(12) United States Patent
Shirasaki et al.

(10) Patent No.: US 8,120,601 B2
(45) Date of Patent: Feb. 21, 2012

(54) DISPLAY DRIVE APPARATUS, DISPLAY APPARATUS AND DRIVE CONTROL METHOD THEREOF

(75) Inventors: Tomoyuki Shirasaki, Higashiyamato (JP); Jun Ogura, Fussa (JP); Satoru Shimoda, Tokyo (JP)

(73) Assignee: Casio Computer Co., Ltd., Tokyo (JP)

( * ) Notice: Subject to any disclaimer, the term of this patent is extended or adjusted under 35 U.S.C. 154(b) by 558 days.

(21) Appl. No.: 12/369,134

(22) Filed: Feb. 11, 2009

(65) Prior Publication Data

US 2009/0207160 A1 Aug. 20, 2009

(30) Foreign Application Priority Data

Feb. 15, 2008 (JP) ..... 2008-033974

(51) Int. Cl.
*G09F 3/038* (2006.01)
*G09G 5/00* (2006.01)

(52) U.S. Cl. ..... 345/204; 345/77; 345/690; 345/80; 345/82; 315/169.1; 315/169.3

(58) Field of Classification Search ..... 345/46, 345/76, 77, 80, 82, 204, 690; 315/169.1, 315/169.3
See application file for complete search history.

(56) References Cited

U.S. PATENT DOCUMENTS 5,640,067 A 6/1997 Yamauchi et al.
5,831,605 A * 11/1998 Yasui et al. ..... 345/211
6,094,982 A 8/2000 Suzuki
6,734,636 B2 5/2004 Sanford et al.
2006/0007249 A1 * 1/2006 Reddy et al. ..... 345/690
2008/0036708 A1 2/2008 Shirasaki et al.
2008/0246785 A1 10/2008 Shirasaki et al.

FOREIGN PATENT DOCUMENTS

CN 1381711 A 11/2002
JP 8-330600 A 12/1996
JP 10-281833 A 10/1998
JP 2005-43473 A 2/2005
JP 2008-46155 A 2/2008

(Continued)

OTHER PUBLICATIONS

Korean Office Action dated Sep. 2, 2010 (and English translation thereof) in counterpart Korean Application No. 10-2009-0011867.

(Continued)

*Primary Examiner* — Lun-Yi Lao
*Assistant Examiner* — Insa Sadio
(74) *Attorney, Agent, or Firm* — Holtz, Holtz, Goodman & Chick, PC

(57) ABSTRACT

A display drive apparatus for driving a display pixel including a light-emitting element and a drive element in which one end of a current path is connected to the light-emitting element. The display drive apparatus has a specific value detection section detecting a difference value between a measured voltage detected at one end of a data line when a reference current is applied via the data line and a standard voltage corresponding to the reference current so as to obtain a specific value corresponding to variation of an element characteristic of the drive element, and a gradation signal correction section generating a corrected gradation signal by correcting a gradation signal according to display data based on the specific value so as to apply the corrected gradation signal from the one end of the data line to the display pixel.

19 Claims, 18 Drawing Sheets

FOREIGN PATENT DOCUMENTS

| | | | |
|---|---|---|---|
| JP | 2008-241803 | A | 10/2008 |
| WO | WO 2008/018629 | A1 | 2/2008 |

OTHER PUBLICATIONS

Japanese Office Action dated May 2, 2011 (and English translation thereof) in counterpart Japanese Application No. 2008-033974.

Chinese Office Action dated May 4, 2011 (and English translation thereof) in counterpart Chinese Application No. 200910007416.5.

Japanese Office Action dated Mar. 10, 2010 and English translation thereof in counterpart Japanese Application No. 2008-033974.

* cited by examiner

DISPLAY DRIVE APPARATUS, DISPLAY APPARATUS AND DRIVE CONTROL METHOD THEREOF

CROSS-REFERENCE TO RELATED APPLICATIONS

This application is based upon and claims the benefit of priority from prior Japanese Patent Application No. 2008-033974, filed Feb. 15, 2008, the entire contents of which are incorporated herein by reference.

BACKGROUND OF THE INVENTION

1. Field of the Invention

The present invention relates to a display drive apparatus, a display apparatus and drive control method thereof. The invention particularly relates to the display drive apparatus which drives light-emitting elements to emit light by means of supply of a current according to display data and a drive control method thereof, and the display apparatus having the display drive apparatus and a drive control method thereof.

2. Description of the Related Art

In recent years, as next-generation display devices after liquid crystal display apparatuses, light-emitting element display apparatuses (light-emitting element displays) have been actively researched and developed. The light-emitting element display apparatuses have a display panel where current-driven light-emitting elements such as organic electroluminescent elements, inorganic electroluminescent elements and light-emitting diodes (LEDs) are arranged in a matrix pattern.

Particularly in light-emitting element displays adopting an active matrix drive system, display response speed is quick, viewing angle dependence property is absent, luminance, contrast and display image quality can be increased, and a backlight and light guide plate are not necessary unlike publicly-known liquid crystal display apparatuses. For this reason, the light-emitting element displays have very advantageous properties such that further reduction of thickness and weight can be enabled. For this reason, application to various electronic devices is expected in the future.

In the light-emitting element displays to which the active matrix drive system is applied, a thin-film transistor for current control and a thin-film transistor for switches are provided in each element. When a voltage signal according to image data is applied to a gate, the thin-film transistor for current control supplies a current to organic electroluminescent elements. The thin-film transistor for switch carries out switching for supplying a voltage signal according to image data to the gate of the thin-film transistor for current control.

In the light-emitting element display apparatus which controls gradation using such a voltage signal, when a threshold of the thin-film transistor for current control varies over time, the current flowing in the organic electroluminescent elements varies.

BRIEF SUMMARY OF THE INVENTION

The present invention provides a display drive apparatus which can compensate a variation of an element characteristic of the drive element and allow light-emitting element to emit light with suitable luminance gradation according to display data, a display apparatus using the display drive apparatus, and a drive control method thereof, so that the display apparatus and drive control method have an advantage of providing a satisfactory and uniform display image quality.

In order to achieve the above advantage, the present invention provides a display drive apparatus for driving a display pixel connected to a data line, the display pixel includes a light-emitting element and a drive element in which one end of a current path is connected to the light-emitting element, the display drive apparatus comprising:

a specific value detection section which obtains a specific value corresponding to variation of an element characteristic of the drive element; and a gradation signal correction section which generates a corrected gradation signal by correcting a gradation signal according to display data based on the specific value and applies the corrected gradation signal as a driving signal from one end of the data line to the display pixel, wherein the specific value detection section has a difference value detection section which detects a difference value composed of a value obtained by amplifying, with a preset amplification ratio, a difference voltage between a measured voltage and a standard voltage, the measured voltage is a detected voltage at the one end of the data line when a reference current is allowed to flow in the current path of the drive element on the display pixel via the data line and the standard voltage is corresponding to the magnitude of the reference current, and the specific value detection section obtains the specific value based on the difference value.

In order to achieve the above advantage, the present invention provides a display apparatus which displays image information, comprising:

at least one display pixel including a light-emitting element and a drive element in which one end of a current path is connected to the light-emitting element;

at least one data line which is connected to the display pixel; and a data driving section which includes a specific value detection section which obtains a specific value corresponding to variation of an element characteristic of the drive element, and a gradation signal correction section which generates a corrected gradation signal by correcting a gradation signal according to display data based on the specific value so as to apply the corrected gradation signal as a driving signal from one end of the data line to the display pixel, wherein the specific value detection section has a difference value detection section which detects a difference value composed of a value obtained by amplifying, with a preset amplification ratio, a difference voltage between a measured voltage and a standard voltage, the measured voltage is a detected voltage at the one end of the data line when a reference current is allowed to flow in the current path of the drive element on the display pixel via the data line and the standard voltage is corresponding to the magnitude of the reference current, and the specific value detection section obtains the specific value based on the difference value.

In order to achieve the above advantage, the present invention provides a drive control method for a display apparatus for displaying image information, the display apparatus including at least one display pixel including a light-emitting element and a drive element in which one end of a current path is connected to the light-emitting element, the method comprising:

a step of supplying a reference current to the display pixel via a data line connected to the display pixel;

a step of detecting a difference value obtained by amplifying, with a preset amplification ratio, a difference voltage between a measured voltage detected at one end of the data line and a standard voltage, the standard voltage is corresponding to a magnitude of the reference current;

a step of obtaining a specific value corresponding to a variation of an element characteristic of the drive element based on the difference value; and a step of generating a corrected gradation signal by correcting a gradation signal according to display data based on the specific value so as to apply the corrected gradation signal as a driving signal from one end of the data line to the display pixel.

DETAILED DESCRIPTION OF INVENTION

Figure 1:
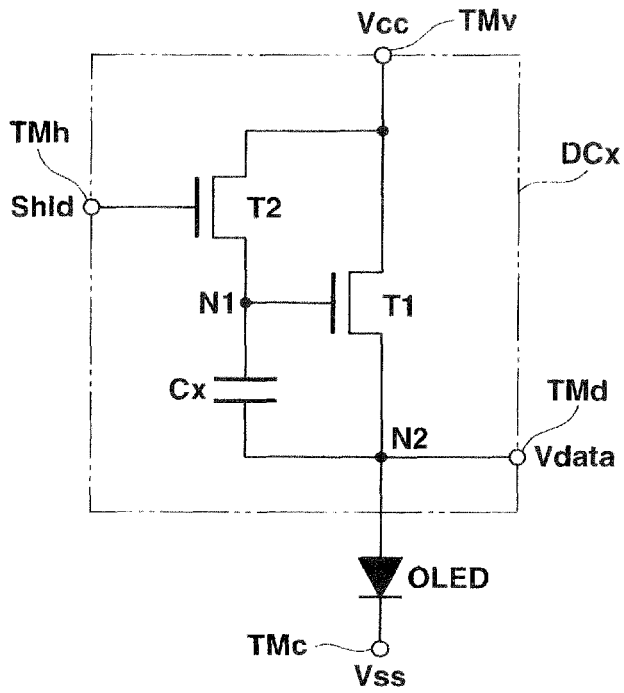
FIG. 1 is an equivalent circuit diagram illustrating a main section constitution of a display pixel to be applied to a display apparatus according to the present invention.

A display drive apparatus and a drive control method thereof, and a display apparatus and a drive control method thereof according to the present invention will be described in detail below based on an embodiment shown in the drawings.

<Main Section Constitution of Display Pixel>

A main section constitution of a display pixel to be applied to the display apparatus of the present invention and its control operation will be described with reference to the drawings.

FIG. 1 is an equivalent circuit diagram illustrating the main section constitution of the display pixel to be applied to the display apparatus according to the present invention.

For convenience of the description, as a current-driven light-emitting element provided to a display pixel, an organic electroluminescent element is applied.

As shown in FIG. 1, the display pixel which is applied to the display apparatus according to the present invention has a circuit configuration which includes a pixel circuit section (corresponding to a pixel driving circuit DC, described later) DCx and an organic electroluminescent element OLED as the current-driven light-emitting element.

The pixel circuit section DCx has a drive transistor (first switching element) T1, a holding transistor (second switching element) T2 and a capacitor (voltage holding element) Cx. A drain terminal and a source terminal of the drive transistor T1 are connected to a power supply terminal TMv and a contact point N2 to which a power source voltage Vcc is applied, and its gate terminal is connected to a contact point N1. A drain terminal and a source terminal of the holding transistor T2 are connected to a power source terminal TMv (the drain terminal of the drive transistor T1) and the contact point N1, and its gate terminal is connected to a control terminal TMh. The capacitor Cx is connected between the gate and source terminals (between the contact points N1 and N2) of the drive transistor T1. An anode terminal of the organic electroluminescent element OLED is connected to the contact point N2, and a constant voltage Vss is applied to its cathode terminal TMc.

As described in a control operation, described later, the power source voltage Vcc having a magnitude varying according to the operating state is applied to the power source terminal TMv according to the operating state of the display pixel (pixel circuit section DCx). The constant voltage Vss is applied to the cathode terminal TMc of the organic electroluminescent element OLED. A hold control signal Shld is applied to the control terminal TMh, and a data voltage Vdata corresponding to a gradation value of display data is applied to the data terminal TMd connected to the contact point N2.

The capacitor Cx may be parasitic capacitance formed between the gate and source terminals of the drive transistor T1, or capacitative elements which are further connected between the contact points N1 and N2 in parallel in addition to the parasitic capacitance. Further, element constitutions and properties of the drive transistor T1 and the holding transistor T2 are not particularly limited, but an n-channel thin-film transistor is applied here.

<Control Operation of the Display Pixel>

A control operation (drive control method) in the display pixel (the pixel circuit section DCx and the organic electroluminescent element OLED) having the above circuit configuration will be described below.

Figure 2:
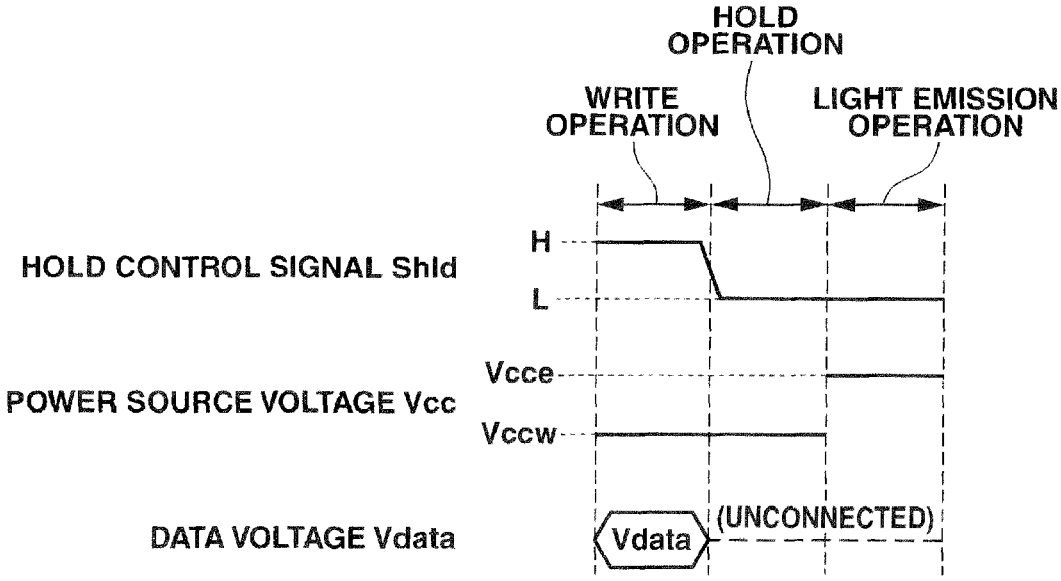
FIG. 2 is a signal waveform chart illustrating a control operation of the display pixel to be applied to the display apparatus according to the present invention.

FIG. 2 is a signal waveform chart illustrating the control operation of the display pixel to be applied to the display apparatus according to the present invention.

As shown in FIG. 2, the operating state in the display pixel (pixel circuit section DCx) having the circuit configuration shown in FIG. 1 can be roughly divided into a write operation, a hold operation and a light emission operation. In the write operation, a voltage component according to a gradation value of display data is written into the capacitor Cx. In the hold operation, the voltage component written in the write operation is held in the capacitor Cx. In the light emission operation, a gradation current according to the gradation value of the display data is applied to the organic electroluminescent element OLED based on the voltage component held by the hold operation, so that the organic electroluminescent element OLED is allowed to emit light with luminance gradation according to the display data. The respective operating states will be specifically described with reference to a timing chart shown in FIG. 2.

(Write Operation)

In the write operation, a voltage component according to a gradation value of display data is written into the capacitor Cx in an extinction state in which the organic electroluminescent element OLED does not emit light.

Figure 3A:
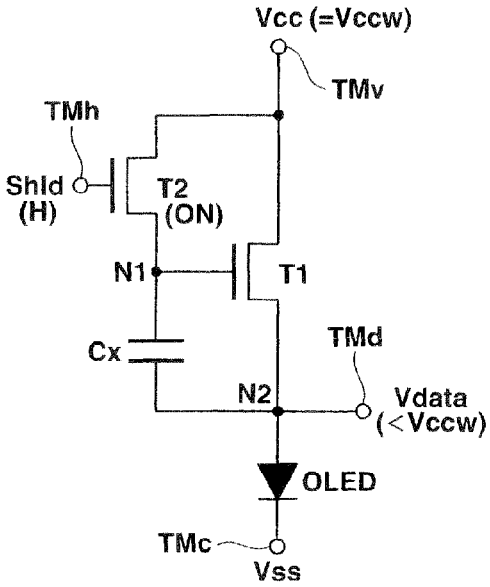
FIGS. 3A and 3B are schematic explanatory diagrams illustrating an operating state at the time of a write operation of the display pixel.
Figure 3B:
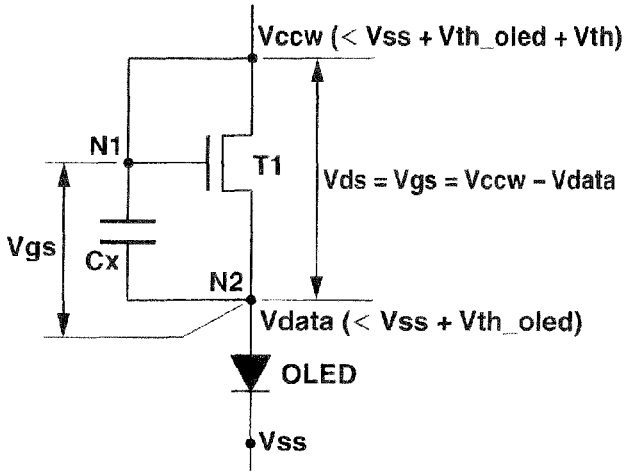

FIGS. 3A and 3B are schematic explanatory diagrams illustrating the operating states of the display pixel at the time of the write operation.

Figure 4A:
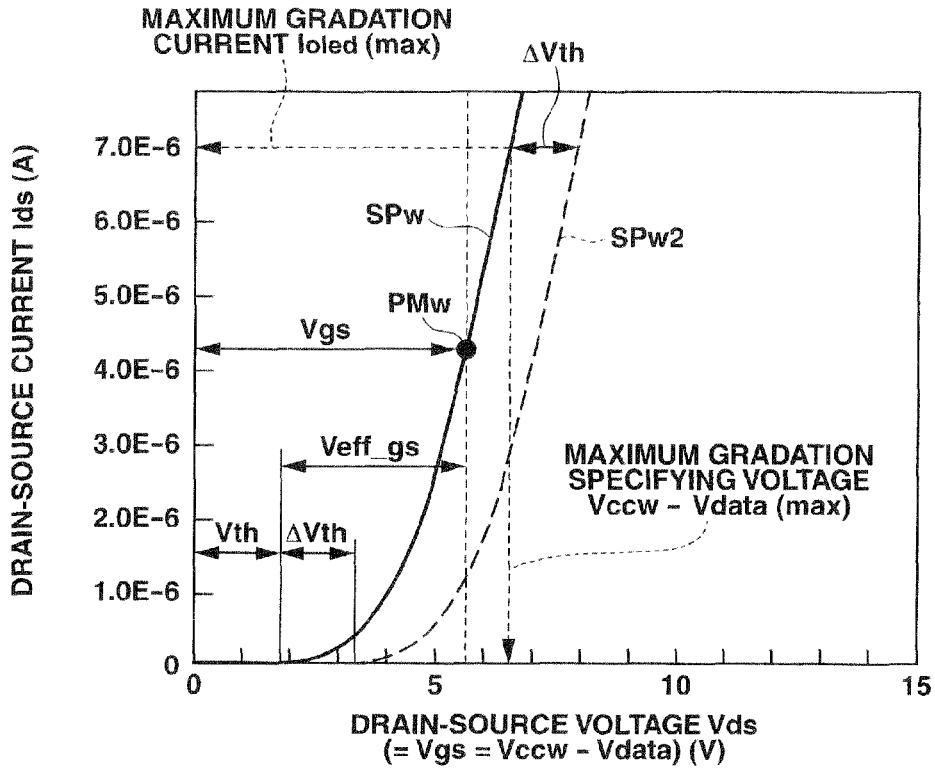
FIG. 4A is a characteristic chart illustrating an operating characteristic of a drive transistor of the display pixel at the time of the write operation.

FIG. 4A is a characteristic chart illustrating an operating characteristic of the drive transistor of the display pixel at the time of the write operation.

Figure 4B:
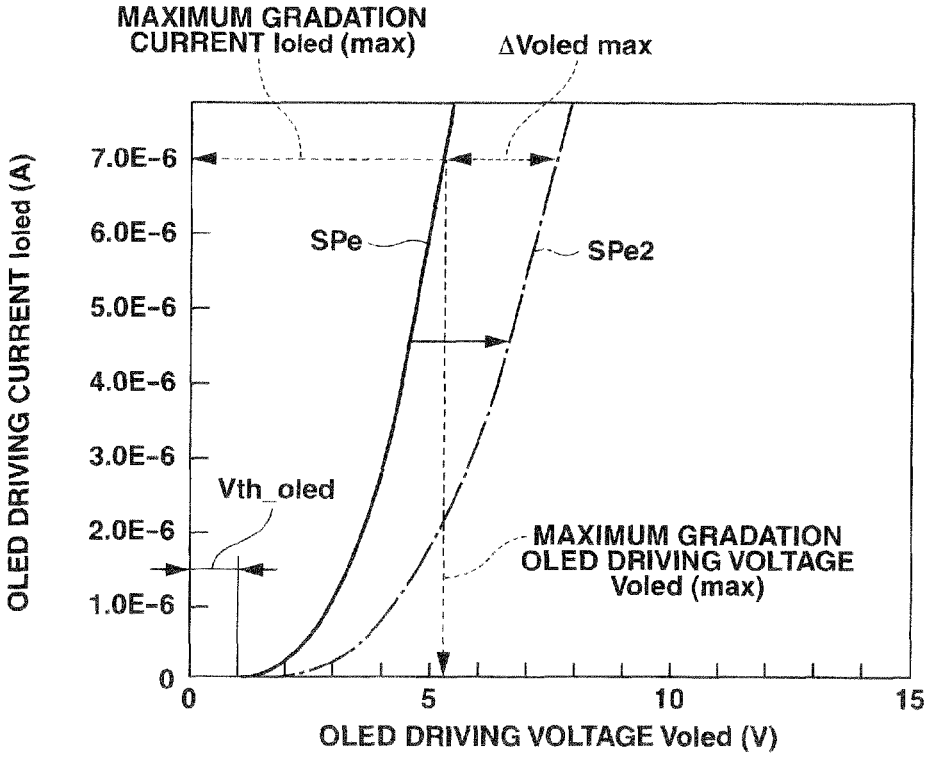
FIG. 4B is a characteristic chart illustrating a relationship between a driving current and a driving voltage of an organic electroluminescent element.

FIG. 4B is a characteristic chart illustrating a relationship between a driving current and a driving voltage of the organic electroluminescent element.

The characteristic charts of FIGS. 4A and 4B are related to an amorphous silicon transistor having a design value shown in Table 1, for example. A threshold voltage Vth in an initial characteristic (voltage-current characteristic) of a drain-source voltage Vds and a drain-source current Ids has a magnitude shown in Table 1, for example.

TABLE 1

| <Transistor design value> | |
|---|---|
| Gate insulating film thickness | 300 nm (3000 Å) |
| Channel width W | 500 μm |
| Channel length L | 6.28 μm |
| Threshold voltage Vth | 2.4 V |

A solid line SPw shown in FIG. 4A is a characteristic line indicating a characteristic (initial characteristic) of the drain-source voltage Vds and the drain-source current Ids in an initial state when the n-channel thin-film transistor is applied as the drive transistor T1 and is diode-connected. A broken line SPw2 indicates one example of a characteristic line of the drive transistor T1 when the characteristic changes from the initial characteristic according to drive history. More details will be described later. A point PMw on the characteristic line SPw indicates the operating point of the drive transistor T1.

The characteristic line SPw has the threshold voltage Vth with respect to the drain-source current Ids. When the drain-source voltage Vds exceeds the threshold voltage Vth, the drain-source current Ids increases in a non-linear pattern according to the increase in the drain-source voltage Vds. That is, in the drawing, a value indicated by Veff_gs is effectively a voltage component forming the drain-source current Ids, and the drain-source voltage Vds becomes a sum of the threshold voltage Vth and the voltage component Veff_gs as shown in Equation 1.

$$Vds = Vth + Veff_gs \quad (1)$$

A solid line SPe shown in FIG. 4B is a characteristic line representing a characteristic (initial characteristic) of the driving current Ioled with respect to the driving voltage Voled in the organic electroluminescent element OLED in the initial state. An alternate long and short dash line SPe2 shows one example of a characteristic line when the characteristic changes from the initial characteristic according to the driving history of the organic electroluminescent element OLED. Its details will be described later.

The characteristic line SPe has a threshold voltage Vth_oled with respect to the driving voltage Voled. When the driving voltage Voled exceeds the threshold voltage Vth_oled, the driving current Ioled increases non-linearly according to the increase in the driving voltage Voled.

At the write operation, as shown in FIGS. 2 and 3A, a hold control signal Shld of an on level (high level) is applied to the control terminal TMh of the holding transistor T2, so that the holding transistor T2 is turned on. As a result, the gate and the drain of the drive transistor T1 are connected (short-circuited), so that the drive transistor T1 is set to a diode-connected state.

Thereafter, a first power source voltage Vccw for the write operation is applied to the power source terminal TMv, and a data voltage Vdata corresponding to the gradation value of the display data is applied to the data terminal TMd. At this time, a current Ids according to a potential difference between the source and the drain (Vccw−Vdata) flows between the drain and the source of the drive transistor T1. The data voltage Vdata is set to allow the current Ids flowing between the drain and the source to have a magnitude necessary for the organic electroluminescent element OLED to emit light with the luminance gradation according to the gradation value of the display data.

At this time, since the drive transistor T1 is diode-connected, as shown in FIG. 3B, the drain-source voltage Vds of the drive transistor T1 is equal to the gate-source voltage Vgs, and is as expressed by the following Equation (2).

$$Vds = Vgs = Vccw - V\mathrm{data} \quad (2)$$

The gate-source voltage Vgs is written into the capacitor Cx (charged).

A condition necessary for the first power source voltage Vccw will be described below. Since the drive transistor T1 is of an n-channel type, a gate potential of the drive transistor T1 should be positive with respect to a source potential in order to supply the drain-source current Ids. The gate potential is equal to a drain potential and is the first power source voltage Vccw, and the source potential is the data voltage Vdata. For this reason, a relationship expressed by the following Equation (3) must hold.

$$V\mathrm{data} < Vccw \quad (3)$$

The contact point N2 is connected to the data terminal TMd and an anode terminal of the organic electroluminescent element OLED. The potential Vdata at the contact point N2 should be a value or less obtained by adding the threshold voltage Vth_oled of the organic electroluminescent element OLED to the voltage Vss of the cathode terminal TMc of the organic electroluminescent element OLED in order to bring the organic electroluminescent element OLED into an extinction state at the time of writing. For this reason, the potential Vdata at the contact point N2 must satisfy Equation 4.

$$V\text{data} \leqq Vss + Vth_oled \quad (4)$$

When Vss is a ground potential 0V, Equation 5 holds.

$$V\text{data} \leqq Vth_oled \quad (5)$$

The following Equation (6) is obtained based on Equations 2 and 5.

$$Vccw - Vgs \leqq Vth_oled \quad (6)$$

Further, since Vgs=Vds=Vth+Veff_gs according to Equation 1, Equation 7 holds.

$$Vccw \leqq Vth_oled + Vth + Veff_gs \quad (7)$$

Since Equation 7 should hold even when Veff_gs=0, at this time, Equation 8 holds.

$$V\text{data} < Vccw \leqq Vth_oled + Vth \quad (8)$$

That is, at the time of the write operation, the first power source voltage Vccw must be set to satisfy Equation 8 in the diode connected state.

Influences of the characteristic change in the drive transistor T1 and the organic electroluminescent element OLED according to the drive history will be described below.

It is known that the threshold voltage Vth of the drive transistor T1 increases according to the driving history. The broken line SPw2 shown in FIG. 4A illustrates one example of the characteristic line when the characteristic changes according to the driving history, and ΔVth represents a variation of the threshold voltage Vth. As shown in the drawing, the characteristic changes into a shape such that the characteristic line SPw of the initial characteristic approximately moves in parallel according to the driving history of the drive transistor T1. For this reason, the data voltage Vdata necessary for obtaining a gradation current (drain-source current Ids) according to the gradation value of the display data must be increased by the variation ΔVth of the threshold voltage Vth.

It is known that the resistance of the organic electroluminescent element OLED becomes high according to the driving history. The alternate long and short dash line SPe2 shown in FIG. 4B shows one example of the characteristic line when the characteristic changes according to the driving history.

The characteristic fluctuates to a direction in which an increase ratio of the driving current Ioled with respect to the driving voltage Voled decreases according to the driving history of the organic electroluminescent element OLED with respect to the characteristic line SPe of the initial characteristic. That is, the driving voltage Voled for supplying the driving current Ioled necessary for allowing the organic electroluminescent element OLED to emit light with the luminance gradation according to the gradation value of the display data increases by characteristic line SPe2—characteristic line SPe. The increase amount becomes maximum at the maximum gradation with which the driving current Ioled obtains a maximum magnitude Ioled (max) as shown by ΔVoled max in FIG. 4B.

(Hold Operation)

Figure 5A:
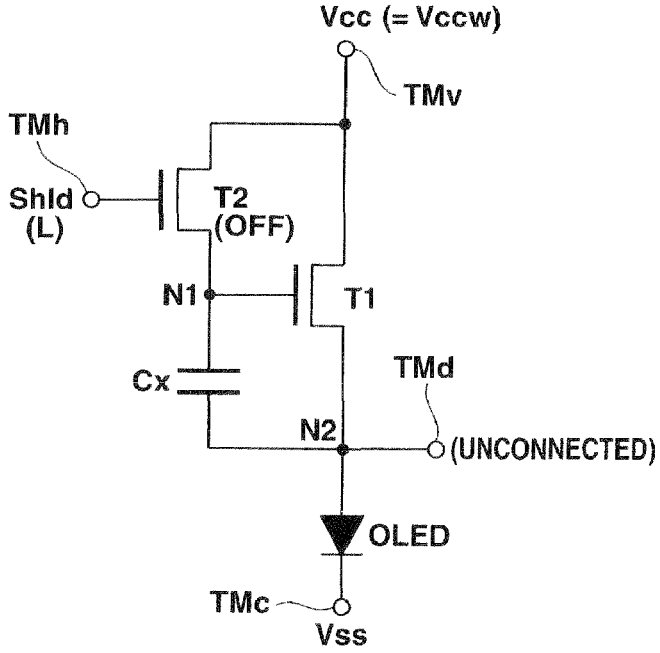
FIGS. 5A and 5B are schematic explanatory diagrams illustrating the operating state of a hold operation of the display pixel.
Figure 5B:
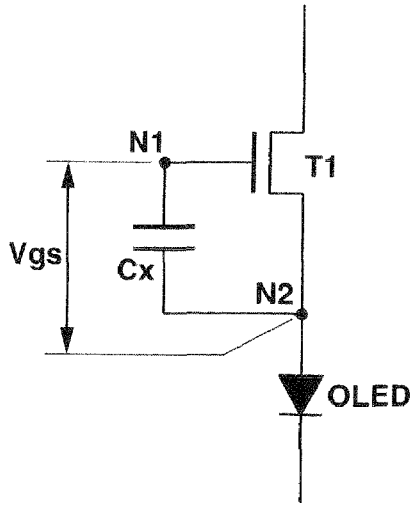

FIGS. 5A and 5B are schematic explanatory diagrams illustrating operating states at the time of the hold operation of display pixel.

Figure 6:
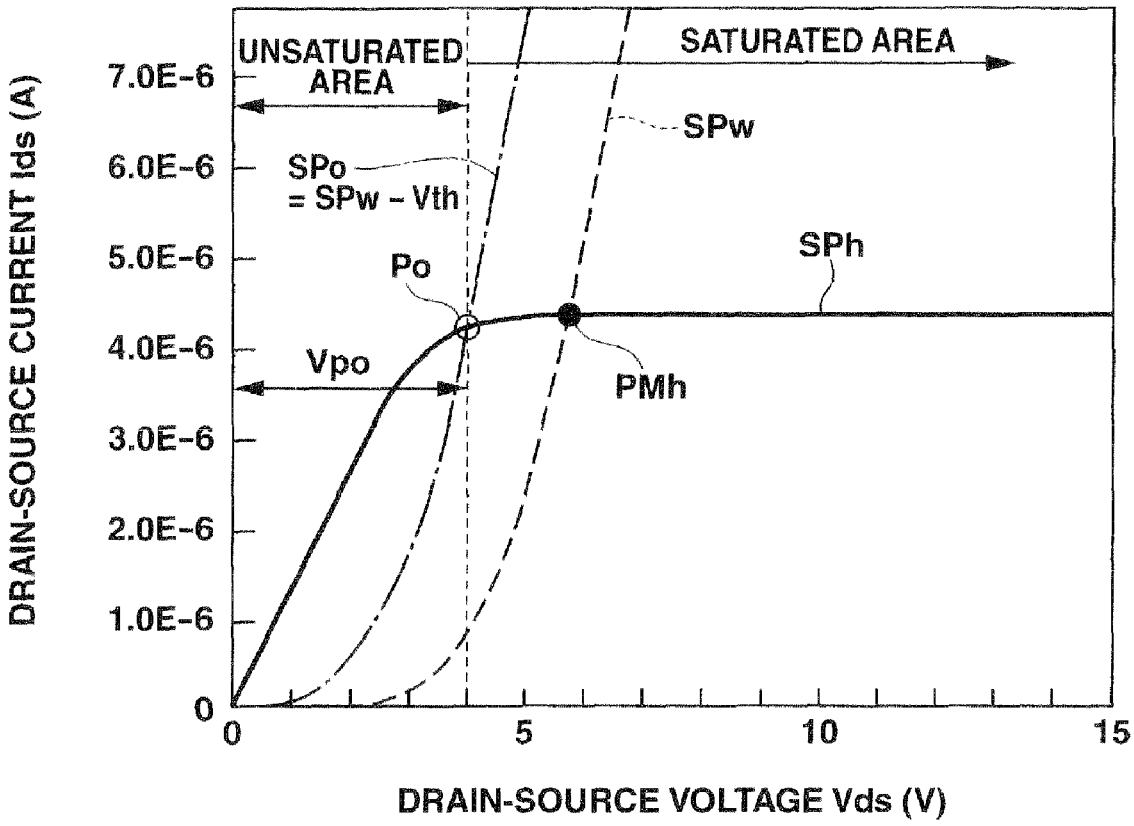
FIG. 6 is a characteristic chart illustrating an operating characteristic of the drive transistor at the time of the hold operation of the display pixel.

FIG. 6 is a characteristic chart illustrating an operating characteristic of the drive transistor at the time of the hold operation of the display pixel.

In the hold operation, as shown in FIGS. 2 and 5A, a hold control signal Shld of an off level (low level) is applied to the control terminal TMh, so that the holding transistor T2 is turned off. As a result, the gate and the drain of the drive transistor T1 are cut off (unconnected), so that the diode connection is released. As a result, as shown in FIG. 5B, the drain-source voltage Vds (=gate-source voltage Vgs) of the drive transistor T1 with which the capacitor Cx is charged in the wiring operation is held.

A solid line SPh shown in FIG. 6 is a characteristic line when the diode connection of the drive transistor T1 is released and the gate-source voltage Vgs is set to a constant voltage. A broken line SPw shown in FIG. 6 is a characteristic line when the drive transistor T1 is diode-connected. An operating point PMh at the time of holding becomes a cross point between the characteristic line SPw at the time of the diode connection and the characteristic line SPh at the time of the release of the diode connection.

An alternate long and short dash line shown in FIG. 6 is derived as [Characteristic line SPw−Vth], and the cross point Po between the alternate long and short dash line SPo and the characteristic line SPh indicates a pinch-off voltage Vpo. As shown in FIG. 6, on the characteristic line SPh, an area where the drain-source voltage Vds is 0V to the pinch-off voltage Vpo is an unsaturated area, and an area where the drain-source voltage Vds is the pinch-off voltage Vpo or more is a saturated area.

(Light Emission Operation)

Figure 7A:
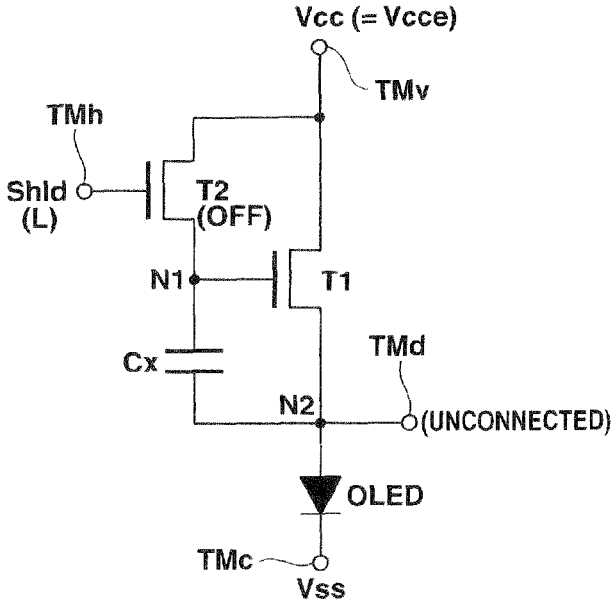
FIGS. 7A and 7B are schematic explanatory diagrams illustrating an operating state at the time of a light emission operation of the display pixel.
Figure 7B:
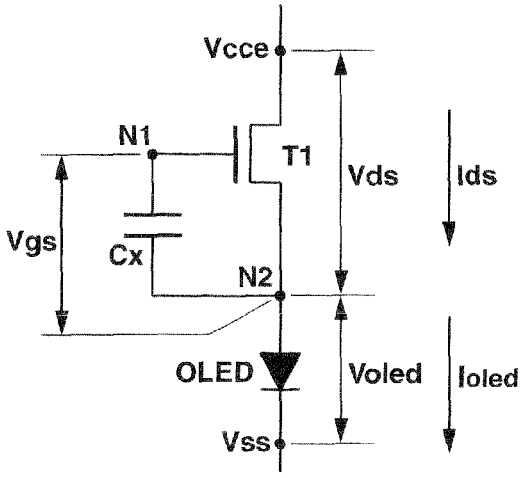

FIGS. 7A and 7B are schematic explanatory diagrams illustrating an operating state at the time of the light emission operation of the display pixels.

Figure 8A:
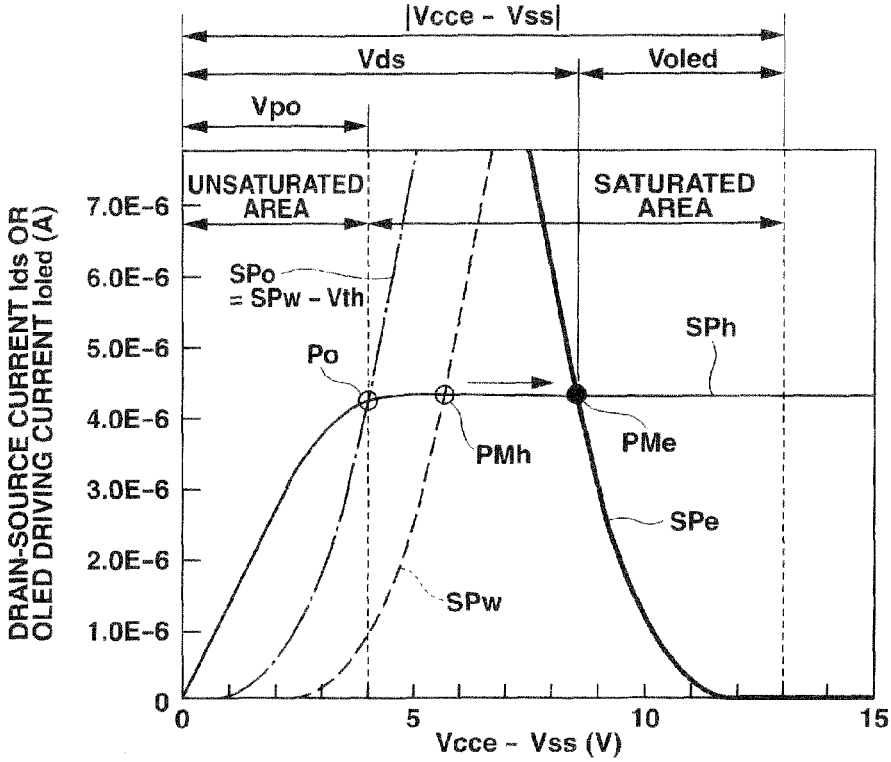
FIG. 8A is a diagram illustrating operating points of the drive transistor at the time of a light emission operation of the display pixel.

FIG. 8A is a diagram illustrating operating points of the drive transistor at the time of the light emission operation of the display pixel.

Figure 8B:
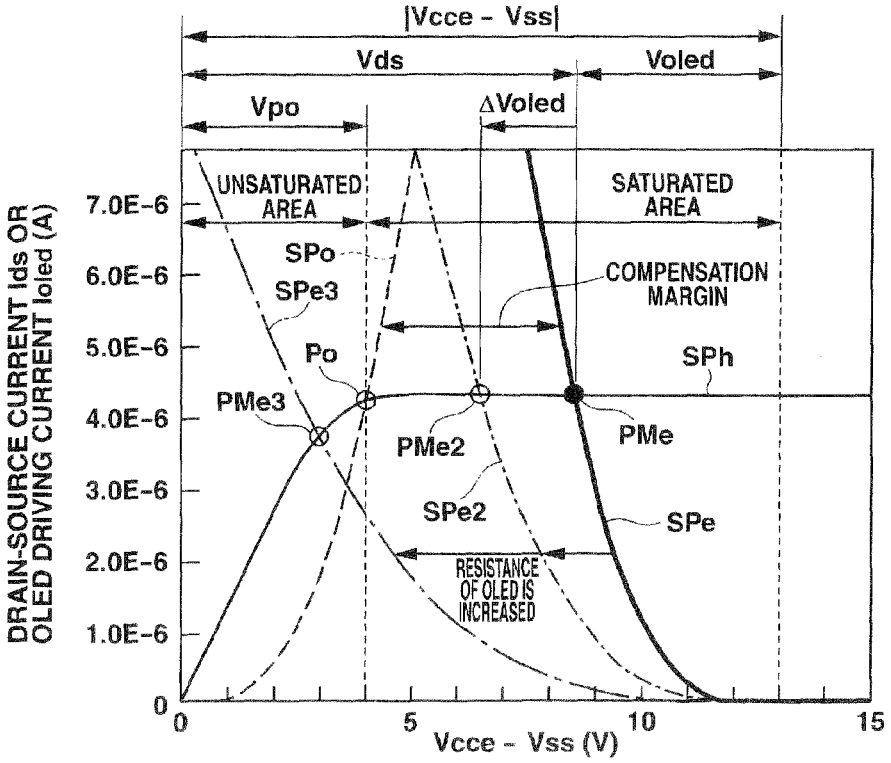
FIG. 8B is a diagram illustrating a change of the operating point of the drive transistor when resistance of the organic electroluminescent element is increased at the time of the light emission operation of the display pixel.

FIG. 8B is a diagram illustrating changes of the operating points of the drive transistor when the resistance of the organic electroluminescent element becomes high at the time of the light emission operation of the display pixel.

As shown in FIGS. 2 and 7A, a state that the hold control signal Shld of the off level (low level) is applied to the control terminal TMh (the state that the diode-connected state is released) is maintained, and the terminal voltage Vcc of the power source terminal TMv is switched from the first power source voltage Vccw for writing into the second power source voltage Vcce for light emission. As a result, the current Ids according to the voltage component Vgs held in the capacitor Cx is applied between the drain and the source of the drive transistor T1, and this current is supplied to the organic electroluminescent element OLED. The organic electroluminescent element OLED emits light with luminance according to the supplied current.

The solid line SPh shown in FIG. 8A is a characteristic line of the drive transistor T1 when the gate-source voltage Vgs is a constant voltage. The solid line SPe indicates a load line of the organic electroluminescent element OLED. The solid line SPe is obtained by plotting the characteristic between the driving voltage Voled and the driving current Ioled of the organic electroluminescent element OLED in a reverse direction based on a potential difference between the power source terminal TMv and the cathode terminal TMc of the organic electroluminescent element OLED, namely, Vcce−Vss.

The operating point of the drive transistor T1 at the time of the light emission operation moves from PMh at the time of the hold operation to PMe as the cross point between the characteristic line SPh of the drive transistor T1 and the load line SPe of the organic electroluminescent element OLED. As shown in FIG. 8A, the operating point PMe shows a point at which the voltage Vcce−Vss is distributed between the source and the drain of the drive transistor T1 and between the anode and the cathode of the organic electroluminescent element OLED in a state that this voltage is applied between the power source terminal TMv and the cathode terminal TMc of the organic electroluminescent element OLED. That is, at the operating point PMe, the voltage Vds is applied between the source and the drain of the drive transistor T1, and the driving voltage Voled is applied between the anode and the cathode of the organic electroluminescent element OLED.

In order not to change the current Ids (expectation current) to be applied between the drain and the source of the drive transistor T1 in the write operation and the driving current Ioled to be supplied to the organic electroluminescent element OLED in the light emission operation, the operating point PMe must be maintained within a saturated area on the characteristic line. Voled indicates the maximum Voled (max) at the time of maximum gradation. In order to maintain PMe within the saturated area, the second power source voltage Vcce must satisfy Equation 9.

$$Vcce-Vss \geqq Vpo+Voled(\max) \quad (9)$$

When Vss is the ground potential 0V, Equation 10 holds.

$$Vcce \geqq Vpo+Voled(\max) \quad (10)$$

The hold operation for switching the hold control signal Shld from an on level into an off level, and the light emission operation for switching the power source voltage Vcc from the voltage Vccw into the voltage Vcce may be performed in a synchronized manner.

<Relationship between Fluctuation of the Organic Element Characteristic and Voltage-Current Characteristic>

As shown in FIG. 4B, the relationship changes such that the resistance of the organic electroluminescent element OLED becomes high according to the driving history, and the increase ratio of the driving current Ioled with respect to the driving voltage Voled decreases. That is, the relationship changes such that a tilt of the load line SPe of the organic electroluminescent element OLED shown in FIG. 8A decreases. FIG. 8B shows a change of the load line SPe of the organic electroluminescent element OLED according to the driving history, and the load line changes such as SPe→SPe2→SPe3. As a result, the operating point of the drive transistor T1 moves on the characteristic line SPh of the drive transistor T1 to a direction of Me→PMe2→PMe3 according to the driving history.

At this time, the driving current Ioled maintains the magnitude of the expectation current at the time of the write operation while the operating point falls within the saturated area on the characteristic line. However, when the operating point is in the unsaturated area (PMe3), the driving current Ioled decreases to be smaller than the expectation current in the write operation, and thus defective display occurs. In FIG. 8B, a pinch-off point Po is on a boundary between the unsaturated area and the saturated area, namely, the potential difference between the operating points PMe and Po in the light emission becomes a compensation margin to maintain the OLED driving current in the light emission with respect to the high resistance of the organic EL. In other words, at respective Ioled levels, the potential difference on the characteristic line SPh of the drive transistor sandwiched between a trajectory SPo of the pinch-off point and the load line SPe of the organic electroluminescent element becomes the compensation margin. As shown in FIG. 8B, the compensation margin decreases according to the increase of the driving current Ioled, and increases according to the increase of the voltage Vcce−Vss applied between the power source terminal TMv and the cathode terminal TMc of the organic electroluminescent element OLED.

<Relationship between Fluctuation of TFT Element Characteristic and Voltage-Current Characteristic>

In the voltage gradation control applied to the display pixel (pixel circuit section), the data voltage Vdata is set based on the characteristic of the drain-source current Ids with respect to the drain-source voltage Vds of the drive transistor T1 at the time when the drive transistor 71 has an initial characteristic.

As shown in FIG. 4A, however, when the threshold voltage Vth of the drive transistor T1 increases according to the driving history, the light emission driving current to be supplied to the light-emitting elements (organic electroluminescent elements OLED) when the data voltages Vdata with the same magnitude are applied thereto decreases further than the case where the drive transistor T1 has the initial characteristic. For this reason, the light-emitting element cannot be allowed to emit light with the luminance gradation according to the gradation value of the display data. Particularly when an amorphous silicon transistor is used as the transistor, the element characteristic fluctuates comparatively greatly.

In the voltage-current characteristic in an n-channel amorphous silicon transistor, namely, the relationship between the drain-source voltage Vds and the drain-source current Ids shown in FIG. 4A, Vth increases due to compensation of a gate field by means of a carrier trap into a gate insulating film according to drive history or temperal change (shift from the characteristic line SPw to the characteristic line SPw2). As a result, the drain-source current Ids decreases with respect to the drain-source voltage Vds applied to the amorphous silicon transistor, and the light emission luminance of the light-emitting element decreases.

Since the element characteristic fluctuates only in the threshold voltage Vth, the V-I characteristic line SPw2 after the shift can be approximately matched with the voltage-current characteristic in the following case. In this case, a constant voltage (corresponding to an offset voltage Vofst described later) corresponding to the variation ΔVth of the threshold voltage Vth (in the drawing, about 2V) is unambiguously added (that is, the V-I characteristic line SPw is moved by ΔVth in parallel) to the drain source voltage Vds of the V-I characteristic line SPw in the initial state.

In other words, when display data is written into the display pixel (pixel circuit section DCx), the constant voltage (offset voltage Vofst) corresponding to the variation ΔV of the element characteristic (threshold voltage) of the drive transistor T1 provided to the display pixel is added so that a data voltage is corrected (corresponding to a corrected gradation voltage (driving signal) Vpix, described later). The corrected data voltage is applied to the source terminal (contact point N2) of the drive transistor T1. As a result, the shift of the voltage-current characteristic due to the fluctuation of the threshold voltage Vth of the drive transistor T1 is compensated, and a driving current Iem having the magnitude according to the gradation of the display data can be supplied to the organic electroluminescent element OLED, so that the light emission operation can be performed with desired luminance gradation.

When the threshold voltage Vth of the drive transistor T1 fluctuates according to the driving history, the driving current Iem having the magnitude according to the gradation of the display data can be applied to the organic electroluminescent element OLED by means of the correction in the case where the resistance of the organic electroluminescent element OLED is not increased according to the driving history. In general, however, a heightening level of the resistance of the organic electroluminescent element OLED due to the driving history is very smaller than the fluctuation of the threshold voltage Vth according to the driving history of the drive transistor T1.

Actually, therefore, when the driving history is corrected only according to the fluctuation of the threshold voltage Vth of the drive transistor T1, the driving current Iem with the magnitude according to the gradation of the display data can be controlled so as to be applied to the organic electroluminescent element OLED. The following embodiment has a constitution in which a correction is made according to the fluctuation of the threshold voltage Vth of the drive transistor T1.

Embodiment

An entire constitution of a display apparatus having a display panel, where a plurality of display pixels including the above main section constitution of the pixel circuit section are arranged two dimensionally, will be specifically described below.

<Display Apparatus>

Figure 9:
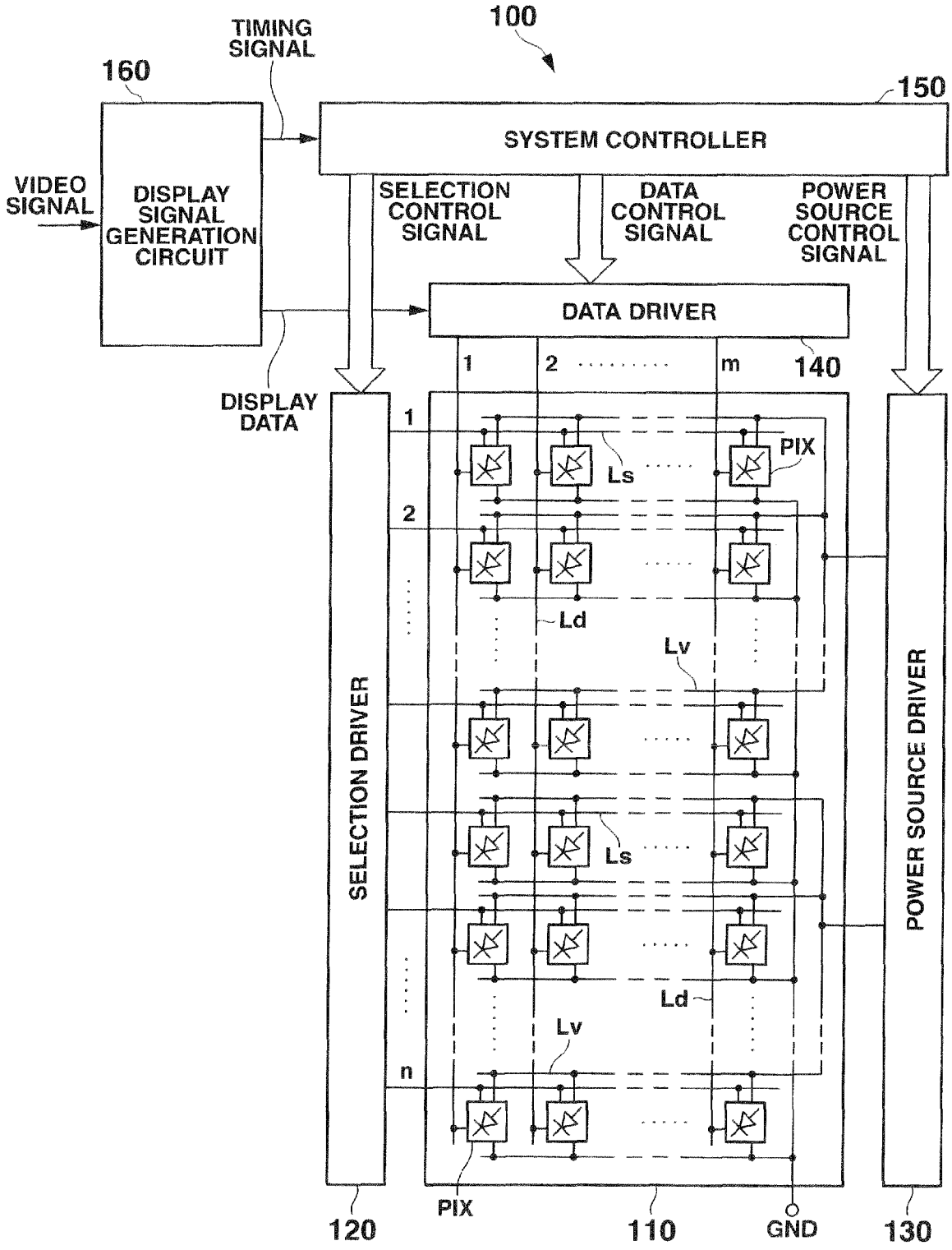
FIG. 9 is a schematic constitutional diagram illustrating the display apparatus according to an embodiment of the present invention.

FIG. 9 is a schematic constitutional diagram illustrating the display apparatus according to the embodiment of the present invention.

Figure 10:
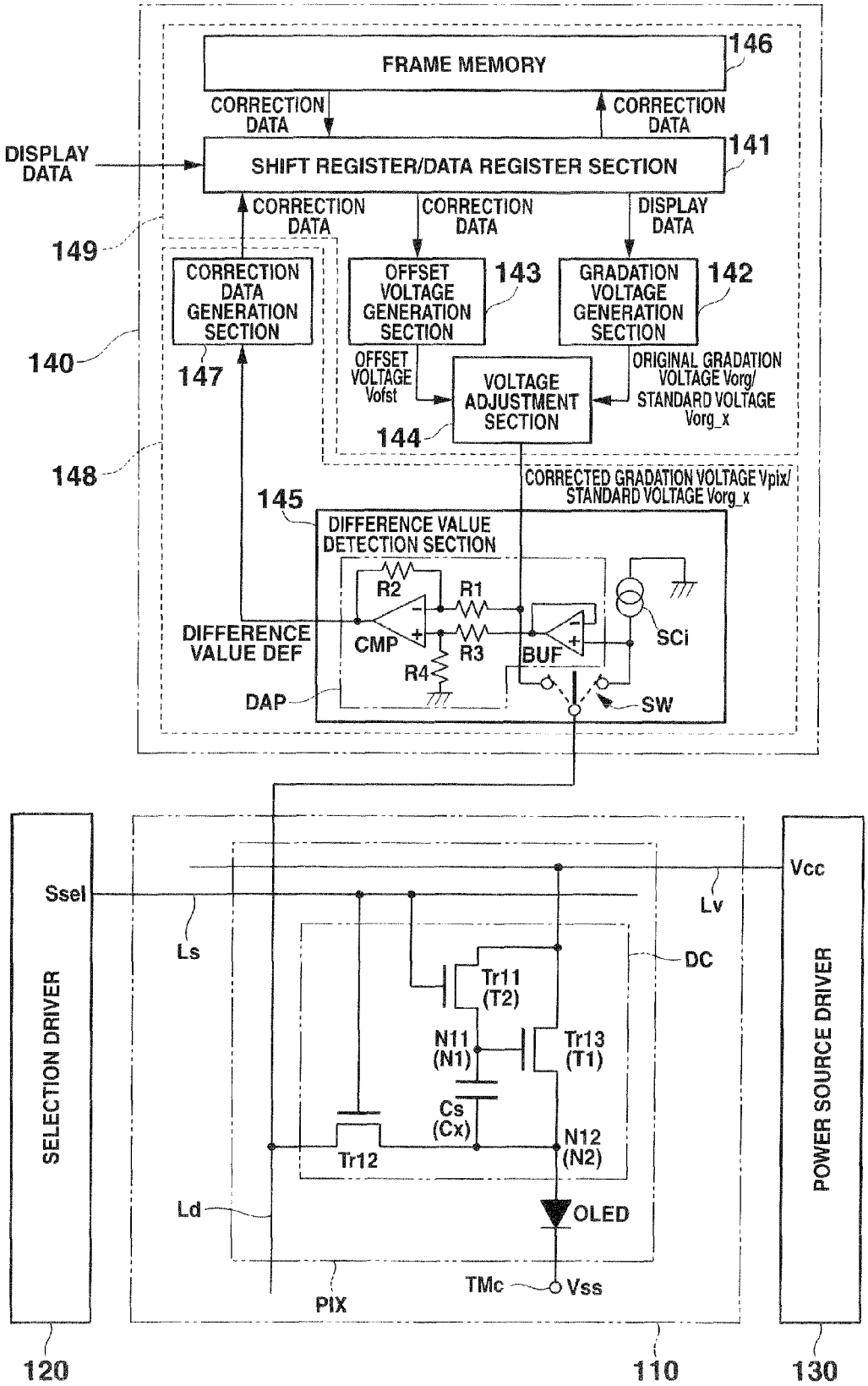
FIG. 10 is a main section constitutional diagram illustrating one example of a data driver and the display pixel to be applied to the display apparatus according to the embodiment.

FIG. 10 is a main section constitutional diagram illustrating one example of the data driver and display pixel (pixel driving circuit and light-emitting element) applicable to the display apparatus according to the embodiment.

In FIG. 10, symbols of the circuit configuration corresponding to the pixel circuit section DCx (see FIG. 1) are also described. In FIG. 10, for convenience of the description, various signals and data transmitted between the constitutions of the data driver, and all currents and voltages to be applied are shown by arrows for descriptive purposes. However, as described later, these signals and data, and currents and voltages are not always transmitted nor applied simultaneously.

As shown in FIGS. 9 and 10, a display apparatus 100 according to the embodiment has a display panel 110, a selection driver (selection driving section) 120, a power source driver (power source driving section) 130, a data driver (display driving apparatus, data driving section) 140, a system controller 150 and a display signal generation circuit 160.

The display panel 110 has a plurality of select lines Ls, a plurality of power source voltage lines Lv, a plurality of data lines Ld, and a plurality of display pixels PIX. The select lines Ls are disposed in a row direction (a right-left direction in the drawing). The power source voltage lines Lv are disposed in the row direction in parallel with the select lines Ls. The data lines Ld are disposed in a column direction (an up-down direction in the drawing). The display pixels PIX include the main section constitution (see FIG. 1) of the pixel circuit section DCx, and are arranged near cross points between the plurality of select lines Ls and the plurality of data lines Ld into a matrix pattern composed of n rows×m columns (n and m are any positive integers).

The selection driver 120 supplies a select signal Ssel to the select lines Ls at predetermined timing.

The power source driver 130 applies the power source voltage Vcc of a predetermined voltage level to the power source voltage lines Lv at predetermined timing.

The data driver 140 supplies a driving signal (corrected gradation voltage Vpix) to the data lines Ld at predetermined timing.

The system controller 150 generates and outputs a selection control signal, a power source control signal and a data control signal based on the timing signal supplied from the display signal generation circuit 160, described later. The selection control signal and the power source control signal control operating states of at least the selection driver 120, the power source driver 130 and the data driver 140.

The display signal generation circuit 160 generates display data (luminance gradation data) composed of digital signals based on a video signal supplied from the outside of the display apparatus 100 and supplies it to the data driver 140. The display signal generation circuit 160 extracts or generates a timing signal (system clock or the like) to display predetermined image information on a display panel 110 based on the display data so as to supply it to the system controller 150.

The respective constitutions will be described below.

(Display Panel)

In the display apparatus 100 according to the embodiment, the plurality of display pixels PIX are arranged into a matrix pattern on a substrate of the display panel 110, and the display pixels PIX are sorted in an upper area and a lower area of the display panel 110 as shown in FIG. 9. The display pixels PIX included in the groups are connected to branched individual power source voltage lines Lv, respectively. That is, power source voltages Vcc to be applied commonly to the display pixels PIX on 1st to n/2nd lines on the upper area of the display panel 110, and the power source voltages Vcc to be applied commonly to the display pixels PIX on 1+n/2 to n-th lines are output independently via the power source voltage lines Lv at different timings by the power source driver 130.

The selection driver 120 and the data driver 140 may be arranged in the display panel 110. In some cases, the selection driver 120, the power source driver 130 and the data driver 140 may be arranged in the display panel 110.

(Display Pixel)

The display pixels PIX applied to the embodiment are arranged near cross points between the select lines Ls connected to the selection driver 120 and the data lines Ld connected to the data driver 140.

For example, as shown in FIG. 10, the display pixel PIX has the organic electroluminescent element OLED as a current-driven light-emitting element and the pixel driving circuit DC. The pixel driving circuit DC includes the main section constitution (see FIG. 1) of the pixel circuit section DCx, and generates a light emission driving current for driving light emission of the organic electroluminescent element OLED.

The pixel driving circuit DC has a transistor Tr11 (transistor for diode connection), a transistor Tr12 (selecting transistor), a transistor Tr13 (drive transistor: drive element) and a capacitor (voltage holding element) Cs. A gate terminal of the transistor Tr11 is connected to the select line Ls, its drain terminal is connected to the power source voltage line Lv, and its source terminal is connected to the contact point N11. A gate terminal of the transistor Tr12 is connected to the select line Ls, its source terminal is connected to the data line Ld, and its drain terminal is connected to the contact point N12. A gate terminal of the transistor Tr13 is connected to the contact point N11, its drain terminal is connected to the power source voltage line Lv, and its source terminal is connected to the contact point N12. The capacitor Cs is connected between the contact point N11 and the contact point N12 (between the gate and source terminals of the transistor Tr13).

The transistor Tr13 corresponds to the drive transistor T1 shown in the main section constitution (FIG. 1) of the pixel circuit section DCx, and the transistor Tr11 corresponds to the holding transistor T2. The capacitor Cs corresponds to the capacitor Cx, and the contact points N11 and N12 correspond to the contact points N1 and N2, respectively.

The select signal Ssel applied from the selection driver 120 to the select line Ls corresponds to the hold control signal Shld, and the driving signal (corrected gradation voltage Vpix) applied from the data driver 140 to the data line Ld corresponds to the data voltage Vdata.

The anode terminal of the organic electroluminescent element OLED is connected to the contact point N12 of the pixel driving circuit DC, and the constant voltage Vss as a constant low voltage is applied to the cathode terminal TMc. In the driving operation of the display apparatus, the corrected gradation voltage Vpix applied from the data driver 140, the constant voltage Vss, and the power source voltage Vcc (=Vcce) of high potential applied to the power source voltage line Lv for the light emission operation satisfy Equations 3 to 10 for a write period during which a driving signal (corrected gradation voltage Vpix) according to the display data is supplied to the pixel driving circuit DC. For this reason, the organic electroluminescent element OLED is not turned on at the time of writing.

The capacitor Cs may be a parasitic capacitance formed between the gate and the source of the transistor Tr13, or a capacitance element other than the transistor Tr13 may be connected between the contact points N11 and N12 in addition to the parasitic capacitance, or both of them may be used.

The transistors Tr11 to Tr13 are not particularly limited, but for example, they are composed of an n-channel field effect transistor, so that an n-channel amorphous silicon thin-film transistor can be applied. In this case, already established amorphous silicon manufacturing technique is used, so that the pixel driving circuit DC composed of the amorphous silicon thin-film transistors whose element characteristic (electron mobility) is stable can be manufactured by a comparatively simple manufacturing process. The following describes a case where the n-channel thin-film transistors are applied to all the transistors Tr11 to Tr13.

The circuit configuration of the display pixel PIX (pixel driving circuit DC) is not limited to the one shown in FIG. 10, and may be another circuit configuration as long as it has at least the elements corresponding to the drive transistor T1, the holding transistor T2 and the capacitor Cx shown in FIG. 1, and a current path of the drive transistor T1 is connected to the current-driven light-emitting element (organic electroluminescent element OLED) in series. Further, also the light-emitting element which emits light to be driven by the pixel driving circuit DC is not limited to the organic electroluminescent element OLED, and may be another current-driven light-emitting element such as a light-emitting diode.

(Selection Driver)

The selection driver 120 supplies the select signal Ssel of selecting level (on the display pixel PIX shown in FIG. 1 or 10, high level) to the select lines Ls based on the selection control signal supplied from the system controller 150. As a result, the selection driver 120 sets the display pixels PIX on the respective rows to a selected state.

Specifically, on the display pixels PIX on the respective rows, the high-level select signal Ssel of high level is applied to the select lines Ls sequentially per row at predetermined timing for a correction data acquiring period and a write period. As a result, the display pixels PIX on the respective rows are set to the selected state sequentially.

The selection driver 120 may have a shift register and an output circuit section (output buffer). The shift register sequentially outputs shift signals corresponding to the select lines Ls on the respective rows based on the selection control signal supplied from the system controller 150, described later. The output circuit section converts the shift signals into a predetermined signal level (selecting level), and sequentially outputs the shift signals as the select signals Ssel to the select lines Ls on the respective rows. When a driving frequency of the selection driver 120 is within a range where the operation of the amorphous silicon transistor is operable, some or all of the transistors included in the selection driver 120 may be manufactured together with the transistors Tr11 to Tr13 in the pixel driving circuit DC.

(Power Source Driver)

The power source driver 130 applies the power source voltage Vcc (=Vccw: first power source voltage) of low potential to the power source voltage lines Lv based on the power source control signal supplied from the system controller 150 for the correction data acquiring period and the write period. The power source driver 130 applies the power source voltage Vcc (=Vcce: second power source voltage) whose potential is higher than the power source voltage Vccw of low potential for the light emission period.

In the embodiment, as shown in FIG. 9, the display pixels PIX are sorted in the upper area and the lower area of the display panel 110, and individual power source voltage lines Lv branched into groups are disposed. For this reason, for the respective operating periods, the power source voltages Vcc having the same voltage level are applied to the display pixels PIX arranged in the same area (included in the same group) via the branched power source voltage lines Lv disposed in this area.

The power source driver 130 may have a timing generator (for example, a shift register which sequentially outputs shift signals), and an output circuit section. The timing generator generates timing signals corresponding to the power source voltage lines Lv in the respective areas (groups) based on the power source control signal supplied from the system controller 150. The output circuit section converts the timing signals into predetermined voltage levels (voltages Vccw and Vcce), and outputs the timing signals as the power source voltages Vcc to the power source voltage lines Lv in the respective areas.

(Data Driver)

The data driver 140 obtains correction data (specific value) corresponding to the variation of the element characteristic (threshold voltage) of the light-emission drive transistor Tr13 (corresponding to the drive transistor T1) provided to the respective display pixels PIX (pixel driving circuit DC) arranged on the display panel 110. The data driver 140 stores them correspondingly to the plurality of display pixels PTX.

The signal voltages (original gradation voltages Vorg) corresponding to the display data (luminance gradation) of the respective display pixels PIX supplied from the display signal generation circuit 160, described later, are corrected by an offset set value Vofst based on the correction data. Corrected gradation voltages (driving signals) Vpix are generated so as to be supplied to the display pixels PIX, respectively, via the data lines Ld.

In the embodiment, a reference current (constant current) Iref_x corresponding to predetermined gradation (x gradation) is supplied to the display pixels PIX via the data line Ld. A standard voltage (original gradation voltage) Vorg_x corresponding to the predetermined gradation (x gradation) is subtracted from a measured voltage Vmex_x detected at this time, so that digital data corresponding to a differential voltage as the operated result is acquired as correction data (specific value).

The reference current Iref_x is a current having a magnitude necessary for light emission from the organic electroluminescent element OLED with luminance corresponding to the predetermined gradation (x gradation). The standard voltage Vorg_x is a voltage such that the current Ids applied between the drain and the source of the transistor Tr13 becomes equal to the reference current Iref_x when the light-emission drive transistor Tr13 has the initial characteristic and the standard voltage Vorg_x is supplied to the display pixels PIX via the data lines Ld.

The data driver (display drive apparatus) 140 applied to the embodiment detects a voltage component (difference voltage $\Delta V \approx \Delta Vth$) corresponding to the variation of the element characteristic (threshold voltage) of the light emission drive transistor Tr13 provided to each of the display pixels PIX (pixel driving circuit DC) arranged on the display panel 110 shown in FIG. 9. The data driver 140 converts the voltage component into digital data, and stores the digital data as the correction data corresponding to the plurality of display pixels PIX.

The data driver 140 corrects signal voltages (original gradation voltages Vorg) according to display data (luminance gradation) of the respective display pixels PIX supplied from the display signal generation circuit 160, described later, based on the correction data. As a result, the data driver 140 generates corrected gradation voltages Vpix and supplies them to the display pixels PIX via the data lines Ld.

The data driver 140 has a shift register/data register section 141, a gradation voltage generation section 142, an offset voltage generation section 143, a voltage adjustment section 144, a difference value detection section 145, a frame memory (storage circuit) 146 and a correction data generation section 147 as shown in FIG. 10.

The gradation voltage generation section 142, the offset voltage generation section 143, the voltage adjustment section 144, the difference value detection section 145, the correction data generation section 147 are provided for the data lines Ld on each column.

The difference value detection section 145 and the correction data generation section 147 compose a specific value detection section 148. The frame memory 146, the shift register/data register section 141, the gradation voltage generation section 142, the offset voltage generation section 143 and the voltage adjustment section 144 compose a gradation signal correction section 149.

In the embodiment, as shown in FIG. 10, the frame memory 146 is included in the data driver 140, but the present invention is not limited to this form. The frame memory 146 may be provided outside the data driver 140 independently.

The shift register/data register section 141 has a shift register and a data register. The shift register sequentially outputs shift signals based on a data control signal supplied from the system controller 150. The data register captures correction data output from the correction data generation sections 147 provided for the respective columns based on the shift signals in the correction data acquiring operation, and outputs them to the frame memory 146. The data register transmits display data supplied from the display signal generation circuit to the gradation voltage generation sections 142 provided on the respective columns in the write operation, and captures the correction data output from the frame memory 146 so as to transmit the correction data to the offset voltage generation sections 143 provided on the respective columns.

Specifically, the shift register/data register section 141 selectively executes any one of the following operations (i) to (iii). In the operation (i), the display data (luminance gradation value) corresponding to the display pixel PIX on one row on the display panel 110 supplied sequentially as serial data from the display signal generation circuit are sequentially captured, and are transmitted to the gradation voltage generation sections 142 provided on the respective columns. In the operation (ii), the correction data (digital data) corresponding to the variation of the element characteristics (threshold voltages) of the transistors Tr13 and Tr12 of the respective display pixels PIX (pixel driving circuits DC), which data are output from the correction data generation sections 147 provided on the respective columns, are captured based on an operated result (difference voltage $\Delta V$) in the difference value detection section 145 and are sequentially transmitted to the frame memory 146. In the operation (iii), the correction data of the display pixels PIX on specific one row are sequentially captured from the frame memory 146, and are transmitted to the offset voltage generation sections 143 provided on the respective columns. These operations will be described in detail later.

The gradation voltage generation section 142 has a digital-to-analog converter which converts display data (digital signal) into an analog voltage, and an output circuit which outputs a original gradation voltage Vorg composed of the analog voltage at predetermined timing. The gradation voltage generation section 142 generates an original gradation voltage Vorg having a magnitude for allowing the organic electroluminescent element OLED to perform the light emission operation or the light non-emission operation (black display operation) with predetermined luminance gradation based on the display data of the display pixels PIX captured via the shift register/data register section 141 so as to output it.

The gradation voltage generation section 142 may automatically output a standard voltage Vorg_x to the voltage adjustment section 144 without input from the shift register/data register section 141 instead of an original gradation voltage Vorg output based on the display data cutout from the shift register/data register section 141 when the transistor Tr13 is in a state of the V-I characteristic line SPw. The standard voltage Vorg_x corresponding to a reference current Iref_x of x gradation, described later, is preset in the transistor Tr13.

The offset voltage generation section 143 has digital-to-analog converter which converts the correction data composed of the digital signals taken out from the frame memory 146 into an analog voltage. The offset voltage generation section 143 generates and outputs an offset voltage (compensating voltage) Vofst according to the variation of the threshold voltage Vth of the transistor Tr13 on each of the display pixels PIX (pixel driving circuits DC) ($\Delta Vth$ shown in FIG. 4A, and corresponds to the difference voltage $\Delta V$ generated in the difference value detection section 145, described later) based on the correction data. The offset voltage (compensating voltage) Vofst to be generated is a voltage which is obtained by correcting the variation of the threshold voltage of the transistor Tr13 and the variation of the threshold voltage of the transistor Tr12 on the display pixels PIX (pixel driving circuits DC) so that a corrected gradation current, which is approximated to a magnitude in normal gradation by the corrected gradation voltage Vpix, flows between the drain and the source of the transistor Tr13.

The voltage adjustment section 144 adds the original gradation voltage Vorg output from the gradation voltage generation section 142 and the offset voltage Vofst output from the offset voltage generation section 143. The voltage adjustment section 144 outputs the added value to the data lines Ld disposed in the column direction of the display panel 110 via the difference value detection sections 145. Specifically, in a correction data acquiring operation, described later, the standard voltage Vorg_x as the original gradation voltage Vorg of predetermined gradation (x gradation) to be output from the gradation voltage generation section 142 is output directly to the difference value detection section 145.

On the other hand, in the write operation, the corrected gradation voltage Vpix attains a magnitude which satisfies the following Equation (11). That is, the offset voltage Vofst to be generated by the offset voltage generation section 143 based on the correction data taken out from the frame memory 146 is analog-added to the original gradation voltage Vorg according to the display data output from the gradation voltage generation section 142. A voltage component to be its total sum is output as the corrected gradation voltage Vpix to the data lines Ld.

$$Vpix=Vorg+Vofst \quad (11)$$

The difference value detection section 145 includes a differential amplification circuit (voltage operating section) DAP, a constant current source (current source) SCi and a connection path changeover switch SW. The connection path changeover switch SW selectively connects one end of the data line Ld to any one of an output end of the constant current source Sci and an output end of the voltage adjustment section 144.

The differential amplification circuit DAP has a comparator CMP having an inverting input terminal, a non-inverting input terminal and an output terminal, resistor elements R1, R2, R3 and R4, and a buffer circuit BUF. The differential amplification circuit DAP has the following circuit configuration The inverting input terminal of the comparator CMP is connected to the output end of the voltage adjustment section 144 via the resistor element R1. The non-inverting input terminal is connected to the output end of the constant current source SCi via the resistor element R3 and the buffer circuit BUF and a low potential (for example, ground potential) via the resistor element R4. The output terminal and the inverting input terminal are connected via the resistor element R2. For example, the resistor elements R2 and R4 are set to equal resistances, and the resistor elements R1 and R3 are set to equal resistances. The differential amplification circuit DAP detects a difference voltage ΔV as a difference between a standard voltage input into the non-inverting input end via the resistor element R1 and a measured voltage input into the inverting input terminal via the resistor element R3. The differential amplification circuit DAP outputs a value obtained by amplifying the detected difference voltage ΔV by a set amplification ratio as a difference value DEF. When the resistance of the resistor element R2 is r2 and the resistance of the resistor element R1 is r1, the amplification ratio A of the differential amplification circuit DAP becomes r2/r1 and the amplification ratio A is set, about 1 to 5, for example. Then, when the resistance of the resistor element P2 is set to be equal to the resistance of the resistor element P1, the amplification ratio A becomes 1, and the difference value DEF to be output from the differential amplification circuit DAP becomes equal to a difference between the standard voltage and the measured voltage. When the resistance r2 of the resistor element R2 is made to be larger than the resistance r1 of the resistor element R1, the amplification ratio A becomes larger than 1, and the difference value DEF output from the differential amplification circuit DAP becomes a value obtained by multiplying the difference voltage ΔV between the standard voltage and the measured voltage by the amplification ratio A. In this case, the value output from the differential amplification circuit DAP can be a value obtained by increasing the difference voltage ΔV between the standard voltage and the measured voltage, and thus detection sensitivity of the variation of the measured voltage with respect to the standard voltage can be increased further than the case where the amplification ratio A is 1. For this reason, the resistance r2 of the resistor element P2 is set to be larger than the resistance r1 of the resistor element R1, and thus the amplification ratio A is preferably larger.

In FIG. 10, the differential amplification circuit DAP is composed of one comparator CMP and the resistor elements R1 to R4 and the buffer circuit BUF, but the present invention is not limited to this constitution. A differential amplification circuit composed of a publicly-known instrumentation amplification circuit, for example, may be used. When the differential amplification circuit composed of the instrumentation amplification circuit is used, an error in the detection of the difference voltage ΔV can be decreased further than a case where the differential amplification circuit DAP is composed of one comparator CMP as shown in FIG. 10. This is because the differential amplification circuit composed of the instrumentation amplification circuit has a function for removing in-phase noises. In the instrumentation amplification circuit, since impedance of the input terminal becomes high, the buffer circuit BUF can be omitted.

In the difference value detection section 145, in a state that a predetermined voltage (preferably the power source voltage Vccw of low potential) is applied to the power source voltage lines Lv, the reference current Iref_x is forcibly applied from the display pixels PIX (pixel driving circuits DC) on the selected rows in the selected state to the data driver 140 via the data lines Ld in a drawing manner by using the constant current source SCi. The reference current Iref_x (for example, a current having a magnitude necessary for the organic electroluminescent element OLED to emit light with maximum luminance gradation) has a magnitude corresponding to the present predetermined gradation x (for example, maximum luminance gradation). At this time, a measured voltage Vmes_x measured on the data line Ld (or the constant current source SCi) at the predetermined gradation x is output to a + side input end of the comparator CMP. Collaterally, the power source voltage line Lv is maintained in a state of the predetermined voltage (power source voltage Vccw), and the standard voltage Vorg_x as the original gradation voltage Vorg at the predetermined gradation x output from the voltage adjustment section 144 is input into a − side input end of the comparator CMP.

In the comparator CMP, in a state that the data line Ld is connected to the constant current source SCi by the connection path changeover switch SW, the predetermined reference current Iref_x is applied by using the constant current source SCi. As a result, a difference voltage ΔV (=Vmes_x−Vorg_x) between the measured voltage Vmes_x as a voltage generated in the data line Ld and the standard voltage Vorg_x as a potential generated by the voltage adjustment section 144 (strictly speaking, the gradation voltage generation section 142) is calculated. A value (=A×ΔV) obtained by multiplying the difference voltage ΔV by the amplification ratio A of the differential amplification circuit DAP is output as the difference value DEF to the correction data generation section 147, described later (voltage subtraction process). The difference voltage ΔV as the voltage component calculated by the comparator CMP according to the voltage subtraction process corresponds to a level of characteristic deterioration on the display pixels PIX to be subject to the correction data acquiring operation, more specifically, the variation ΔVth of the threshold voltage Vth of the transistor Tr13 in the pixel driving circuit DC at the x gradation at the time of executing the correction data acquiring operation. The variation ΔVth of the threshold voltage Vth of the transistor Tr13 hardly depends on the value of the luminance gradation (gradation x) specified by the display data, and the variation ΔVth basically does not change at any gradation. The inventors of this application confirms this.

In the write operation, described later, the connection path changeover switch SW disconnects the data line Ld from the constant current source SCi, and connects the voltage adjustment section 144 to the data line Ld. The voltage adjustment section 144 applies the corrected gradation voltage Vpix generated by adding the original gradation voltage Vorg based on the display data and the offset voltage Vofst based on the correction data to the display pixels PIX via the data lines Ld. At this time, however, the reference current Iref_x is not drawn and the standard voltage Vorg_x is not subtracted.

The correction data generation section 147 has an analog-to-digital converter which converts the difference value DEF composed of an analog voltage output from the difference value detection section 145 into a digital signal. The corrected data generation section 147 converts the difference voltage ΔV corresponding to the variation ΔVth of the threshold voltage Vth of the transistor Tr13 on the display pixels PIX (pixel driving circuits DC) into the correction data composed of the digital signal. The correction data generation section 147 outputs the correction data to the frame memory 146 via the shift register/data register section 141. The correction data generation section 147 includes a data conversion circuit. When the amplification ratio A of the differential amplification circuit DAP of the difference value detection section 145 is set to a value larger than 1, the data conversion circuit generates a value (DEF/A) obtained by dividing the difference value DEF output from the difference value detection section 145 by the amplification ratio A of the differential amplification circuit DAP, namely, the difference voltage ΔV between the standard voltage and the measured voltage. The data conversion circuit supplies this value to the analog-to-digital converter. The data conversion circuit may be composed of a publicly-known dividing circuit, for example, or a resistance dividing circuit.

The frame memory 146 sequentially captures the correction data via the shift register/data register section 141 in the correction data acquiring operation to be executed prior to the write operation of the display data (corrected gradation voltage Vpix) into the display pixels PIX arranged on the display panel 110. The correction data is generated in the correction data generation section 147 provided on each column and is composed of digital data of the display pixels PIX on one row (corresponding to the variation ΔVth of the threshold voltage Vth of the transistor Tr13 in the pixel driving circuits Dc). The frame memory 146 stores the correction data of the display pixels PIX for one screen (one frame) of the display panel 1 into individual areas, and sequentially outputs the correction data of the display pixels PIX for one row to the offset voltage generation section 143 via the shift register/data register section 141 in the write operation.

<Method of Driving the Display Apparatus>

A method of driving the display apparatus according to the embodiment will be described below.

The driving operation of the display apparatus 100 according to the embodiment roughly has the correction data acquiring operation and the display driving operation.

In the correction data acquiring operation, the difference voltage ΔV corresponding to the fluctuation of the element characteristic (threshold voltage) of the transistor Tr13 (drive transistor) for driving light emission of the display pixels PIX (pixel driving circuits DC) arranged on the display panel 110 is detected. Further, digital data corresponding to the difference voltage ΔV is stored as the correction data for each display pixel PIX in the frame memory 146.

In the display driving operation, the original gradation voltage Vorg according to the display data is corrected based on the correction data acquired for each display pixel PIX, and is written as the corrected gradation voltage Vpix into each of the display pixels PIX so as to be held as a voltage component. A light emission driving current Iem having a value according to the display data, whose influence of the fluctuation of the element characteristic of the transistor Tr13 is compensated based on the voltage component, is supplied to the organic electroluminescent element OLED so that light is emitted from the organic electroluminescent element OLED with predetermined luminance gradation.

The respective operations will be described below specifically.

(Correction Data Acquiring Operation)

Figure 11:
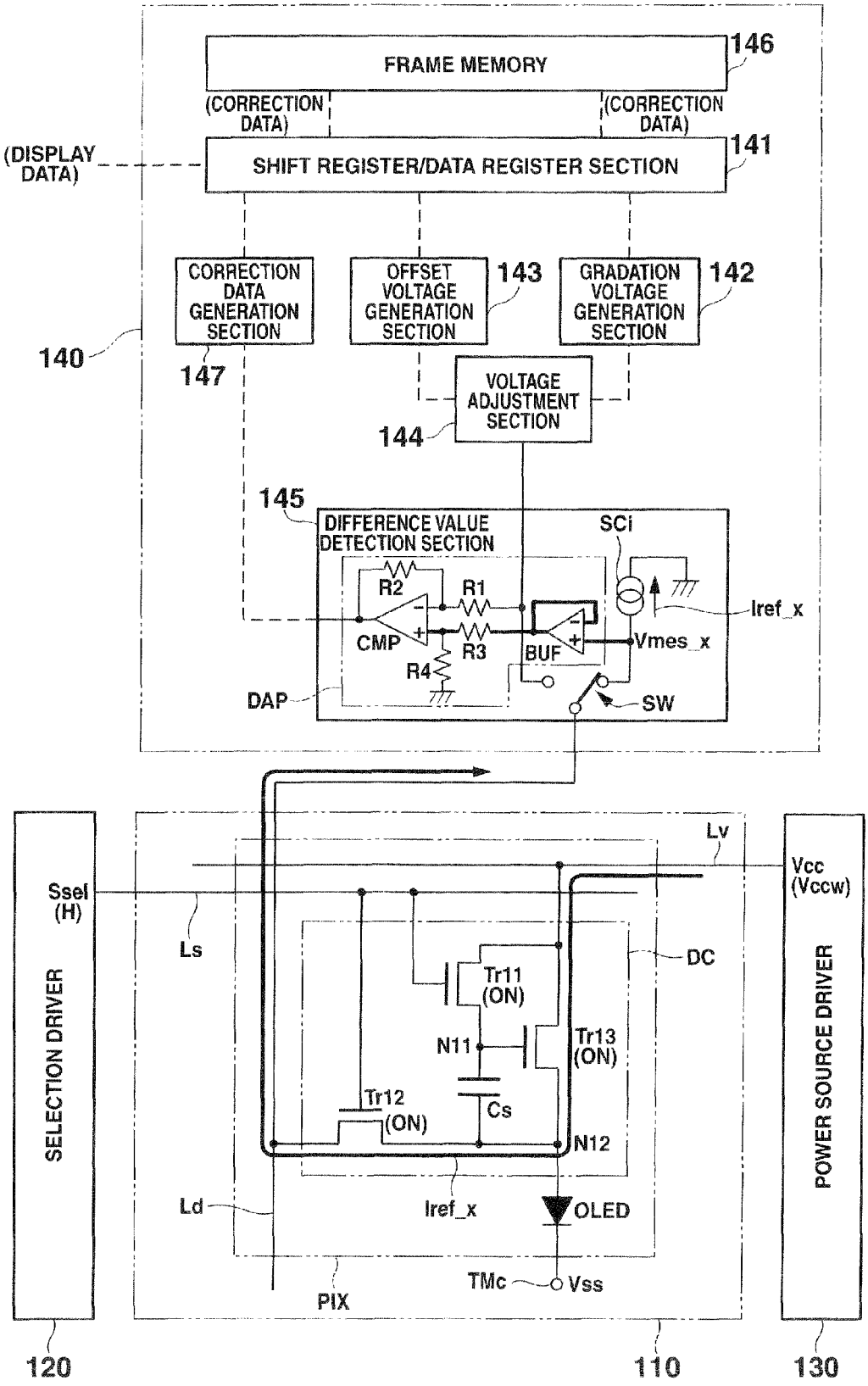
FIG. 11 is a conceptual diagram illustrating a drawing operation of a reference current in a correction data acquiring operation in the display apparatus according to the embodiment.

FIG. 11 is a conceptual diagram illustrating an operation for drawing a reference current in the correction data acquiring operation in the display apparatus according to the embodiment.

Figure 12:
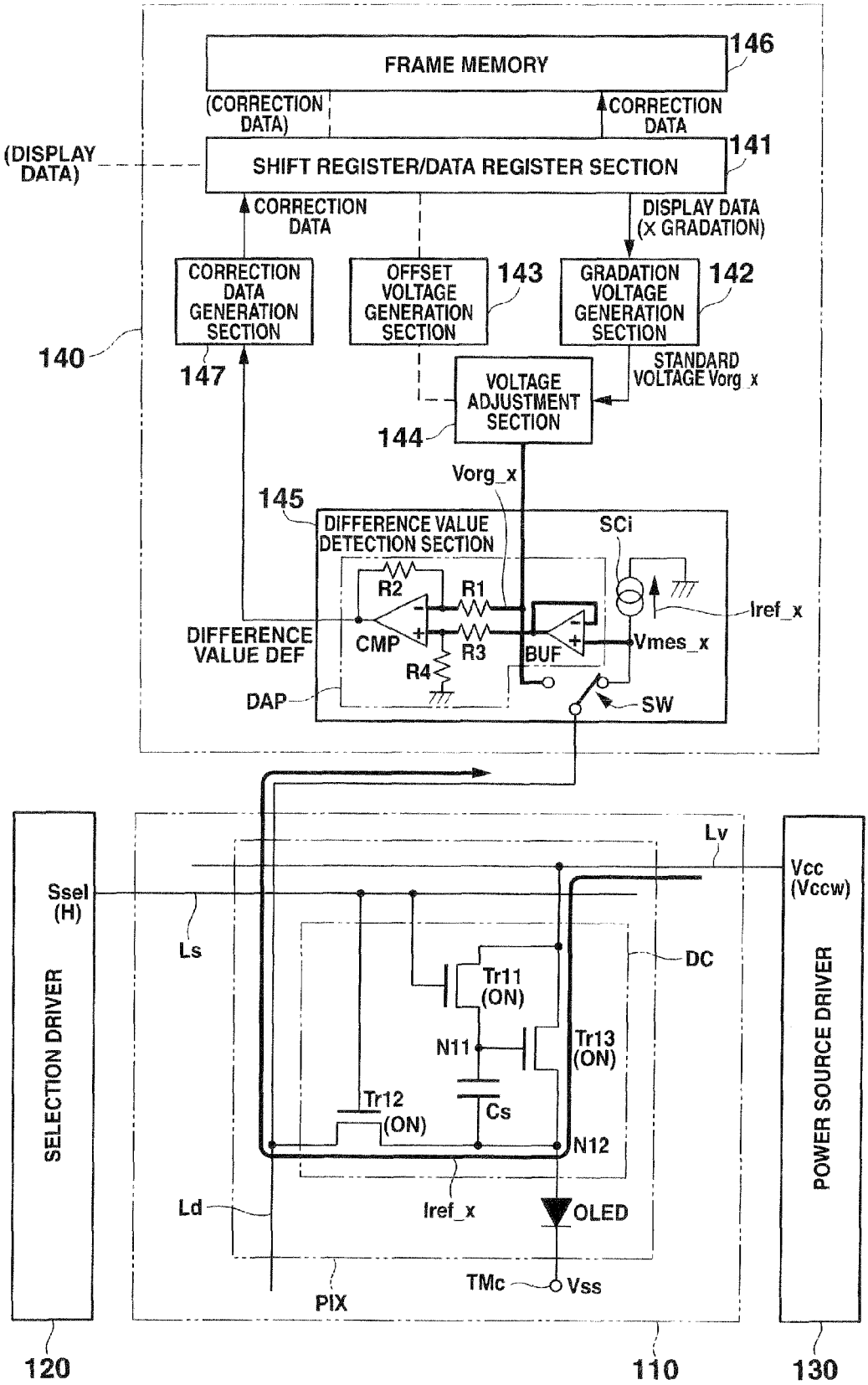
FIG. 12 is a conceptual diagram illustrating an operation for acquiring a measurement voltage and an operation for generating correction data in the correction data acquiring operation in the display apparatus according to the embodiment.

FIG. 12 is a conceptual diagram illustrating a measured voltage capturing operation and a correction data generation operation in the correction data acquiring operation in the display apparatus according to the embodiment.

Figure 13:
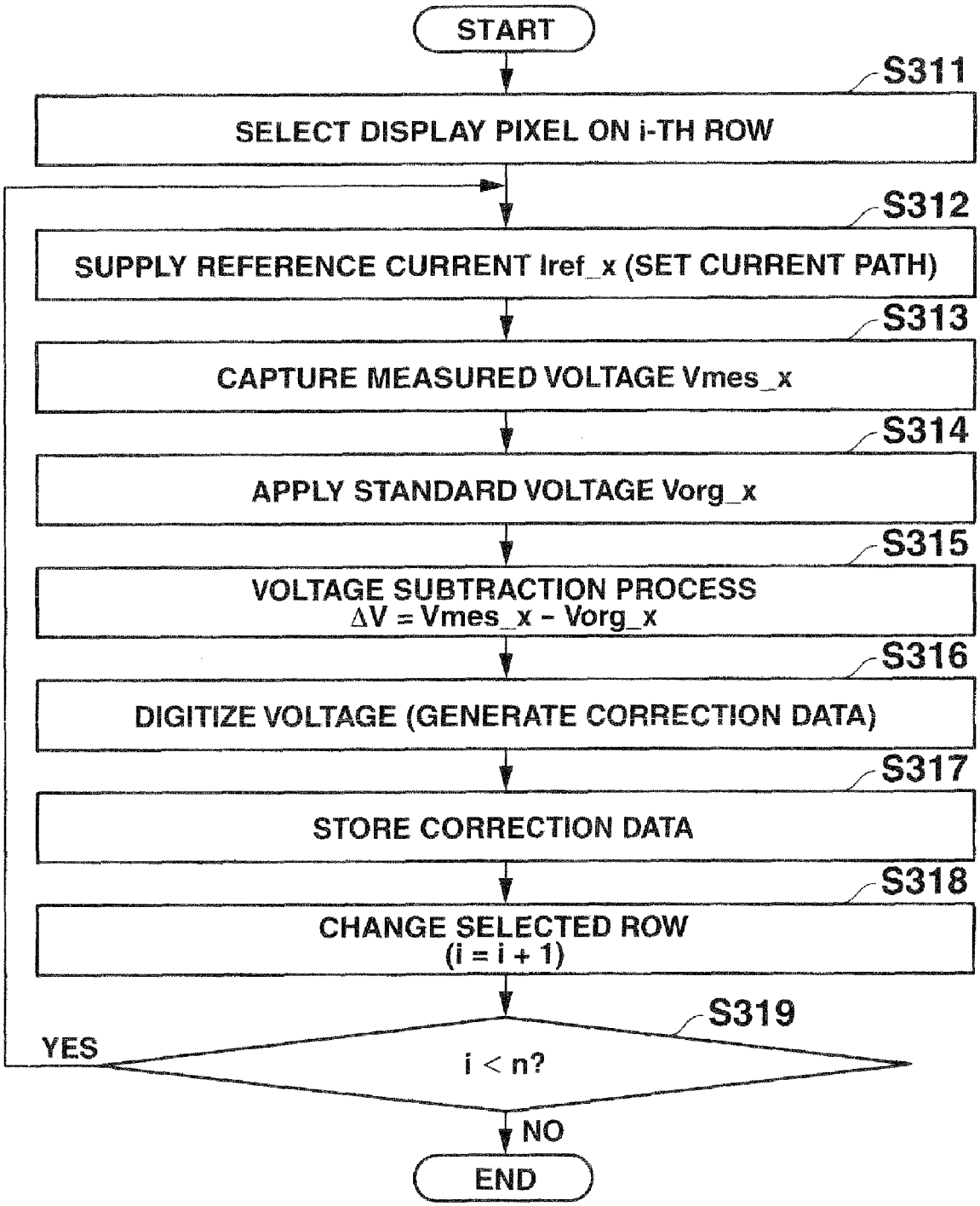
FIG. 13 is a flow chart illustrating one example of the correction data acquiring operation in the display apparatus according to the embodiment.

FIG. 13 is a flow chart illustrating one example of the correction data acquiring operation in the display apparatus according to the embodiment.

In the correction data acquiring operation (offset voltage detection operation) according to the embodiment, as shown in FIG. 13, a power source voltage Vcc (=Vccw≦Vss) of low potential as the write operation level is applied from the power source driver 130 to the power source voltage line Lv (in this embodiment, the power source voltage line Lv connected commonly to all the display pixels PIX in the group including the i-th column) connected to the display pixel PIX on the i-th column (positive integer which satisfies 1≦i≦n). In this state, a select signal Ssel of a selection level (high level) is applied from the selection driver 120 to the select line Ls on the i-th row, and the display pixel PIX on the i-th row is set to a selected state (step S311).

As a result, the transistor Tr11 provided to the pixel driving circuit DC of the display pixel PIX on the i-th row is turned on, and the transistor Tr13 is set to a diode connected state. The power source voltage Vcc (=Vccw) is applied to the drain terminal and the gate terminal (contact point N11; one end of the capacitor Cs) of the transistor Tr13. The transistor Tr12 is also turned on, and the source terminal (contact point N12; the other end of the capacitor Cs) of the transistor Tr13 is electrically connected to the data lines Ld on the respective columns.

As shown in FIG. 11, in the difference value detection section 145, the connection path changeover switch SW connects the data line Ld to the constant current source SCi, and supplies the reference current Iref_x from the data line Ld to the data driver 140 in a drawing manner (step S312).

At this time, the current Ids flowing between the drain and the source of the transistor Tr13 matches the reference current Iref_x. Since a capacitance component parasitic on the data line Ld is actually present, when the current is supplied to the data line Ld, the data line Ld is firstly charged with the capacitance component. For this reason, a delay is generated by the charging time for the capacitance component until the current actually flowing in the data line Ld reaches the set value of the reference current Iref_x after the supply of the reference current Iref_x to the data line Ld is started. The smaller the reference current Iref_x, the longer the charging time. In the correction data acquiring operation, it is preferable that the current flowing in the data line Ld can reach the set value of the reference current Iref_x in a short time. For this reason, the reference current Iref_x is desirably set to be comparatively large corresponding to the maximum luminance gradation or gradation near it.

At the time when the current flowing in the data line Ld reaches the value set as the reference current Iref_x and becomes stable, the potential at the output end of the constant current source SCi is measured. The measured voltage Vmes_x is applied to the + side input end of the comparator CFAP provided in the differential amplification circuit DAP of the difference value detection section 145 (step S313).

The measured voltage Vmes_x varies according to the change in the characteristic of the transistor Tr13 where the reference current Iref_x flows between the rain and the source.

As shown in FIG. 12, the original gradation voltage Vorg corresponding to the display data with the predetermined gradation (for example, x gradation) is generated by the gradation voltage generation section 142 based on the data control signal output from the system controller 150. The original gradation voltage Vorg is output as the standard voltage Vorg_x to the difference value detection section 145 via the voltage adjustment section 144 (that is, it is allowed to pass through the voltage adjustment section 144). As a result, the standard voltage Vorg_x is applied to the − side input end of the comparator CMP provided in the differential amplification circuit DAP (step S314).

In the differential amplification circuit DAP provided to the difference value detection section 145, the difference voltage ΔV (=Vmes_x−Vorg_x) between the measured voltage Vmes_x and the standard voltage Vorg_x captured by the comparator CMP in steps S313 and S314 is calculated. The voltage subtraction process for outputting the difference value DEF (=A×ΔV) composed of a value obtained by multiplying the difference voltage ΔV by the amplification ratio A of the differential amplification circuit DAP is executed (step S315). The difference voltage ΔV is an analog voltage corresponding to the variation ΔVth (ΔV≈ΔVth) of the threshold voltage Vth of the transistor Tr13 in the pixel driving circuit DC at this time on the display pixels PIX to be subject to the correction data acquiring operation.

As shown in FIG. 12, the difference value output from the difference value detection section 145 (differential amplification circuit DAP) is converted into a value corresponding to the difference voltage ΔV in the correction data generation section 147, and is digitized into correction data. The correction data are output to the shift register/data register section 141 (step S316).

The shift register/data register section 141 sequentially transmits the correction data on the respective columns to the frame memory 146, and stores them in the individual areas of the frame memory 146 according to the respective display pixels PIX. The shift register/data register section 141 completes the acquisition of the correction data corresponding to the difference voltage ΔV (namely, the variation ΔVth of the threshold voltage Vth of the transistor Tr13 in the pixel driving circuit DC) (step S317).

After the correction data for the display pixels PIX on the i-th row are acquired, a variable "i" for specifying a row is incremented (i=i+1) (step S318) in order to execute a series of processing operations (steps S311 to S317) on the display pixels PIX on the next row (i−1-th row). Thereafter, it is comparatively determined whether the incremented variable number "i" is smaller than a total number of the rows n set in the display panel 110 (i<n) (step S319).

When the variable "i" is smaller than the number of the rows n (i<n) in step S319, the processes in steps S311 to S318 are again executed. When the variable "i" matches with the number of the rows n (i=n) in step S319, the correction data acquiring operation for the display pixels PIX on the respective rows is executed on all the rows of the display panel 110. The correction data of the display pixels PIX are stored individually into the predetermined storage areas of the frame memory 146, and a series of the correction data acquiring operation is ended.

In the correction data acquiring operation, the potentials at the respective terminals satisfy the relationships of Equations 3 to 10, and thus a current does not flow in the organic electroluminescent element OLED and fight is not emitted therefrom.

In step S314, the standard voltage Vorg_x is applied from the gradation voltage generation section 142 to the difference value detection section 145 (the side input end of the comparator CMP). Step S314 may be executed before any one of the processes in steps S311 to S313.

In the case of the correction data acquiring operation, as shown in FIG. 11, the constant current source SCi is connected to the data line Ld, and the measured voltage Vmes_x is measured at the time when the predetermined reference current Iref_x is allowed to flow in a drawing manner. As shown in FIG. 12, when the drain-source current Ids_x of the transistor Tr13 at the x gradation according to the V-I characteristic line SPw in the initial state has an expectation value, the difference voltage ΔV with respect to the negative-potential original gradation voltage Vorg at the x gradation (namely, standard voltage Vorg_x) for flowing the drain-source current Ids of the transistor Tr13 equivalent or approximate to the expectation value is calculated at the time of writing. A digital signal corresponding to the difference voltage ΔV (analog voltage) is saved as the correction data in the memory frame 146.

In the correction data acquiring operation, as a method for generating the standard voltage Vorg_x using the gradation voltage generation section 142, the standard voltage Vorg_x may be generated by the gradation voltage generation section 142 based on the display data with predetermined gradation supplied from the display signal generation circuit 160. When the standard voltage Vorg_x has a fixed voltage or gradation value, the gradation voltage generation section 142 may output the standard voltage Vorg_x without supplying the display data from the display signal generation circuit 160. At this time, the standard voltage Vorg_x preferably has a magnitude such that the reference current Iref_allows the organic electroluminescent element OLED to emit light with maximum luminance gradation (or gradation near it) for the light emission period.

(Display Driving Operation)

The display driving operation in the display apparatus according to the embodiment will be described below.

Figure 14:
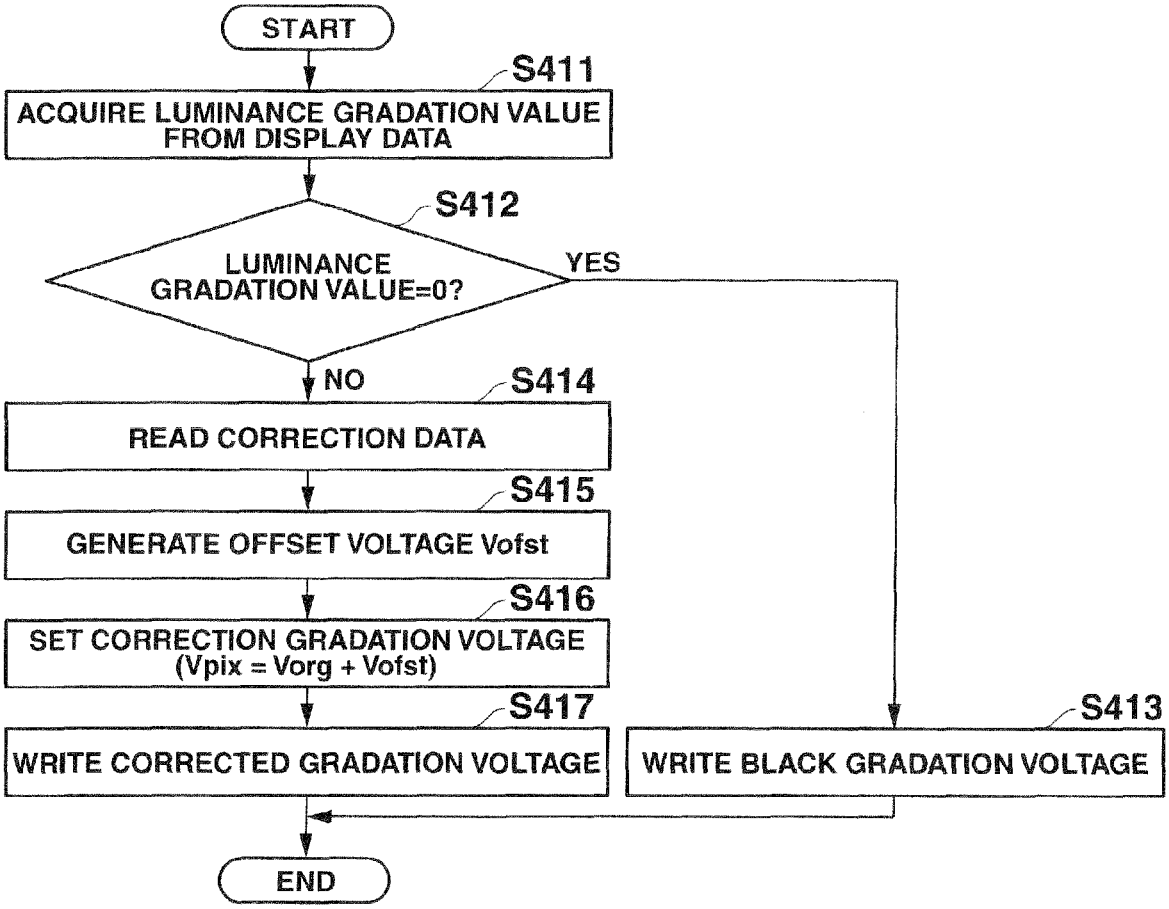
FIG. 14 is a flow chart illustrating one example of a display drive operation in the display apparatus according to the embodiment.

FIG. 14 is a flow chart illustrating one example of the display driving operation (write operation) in the display apparatus according to the embodiment.

Figure 15:
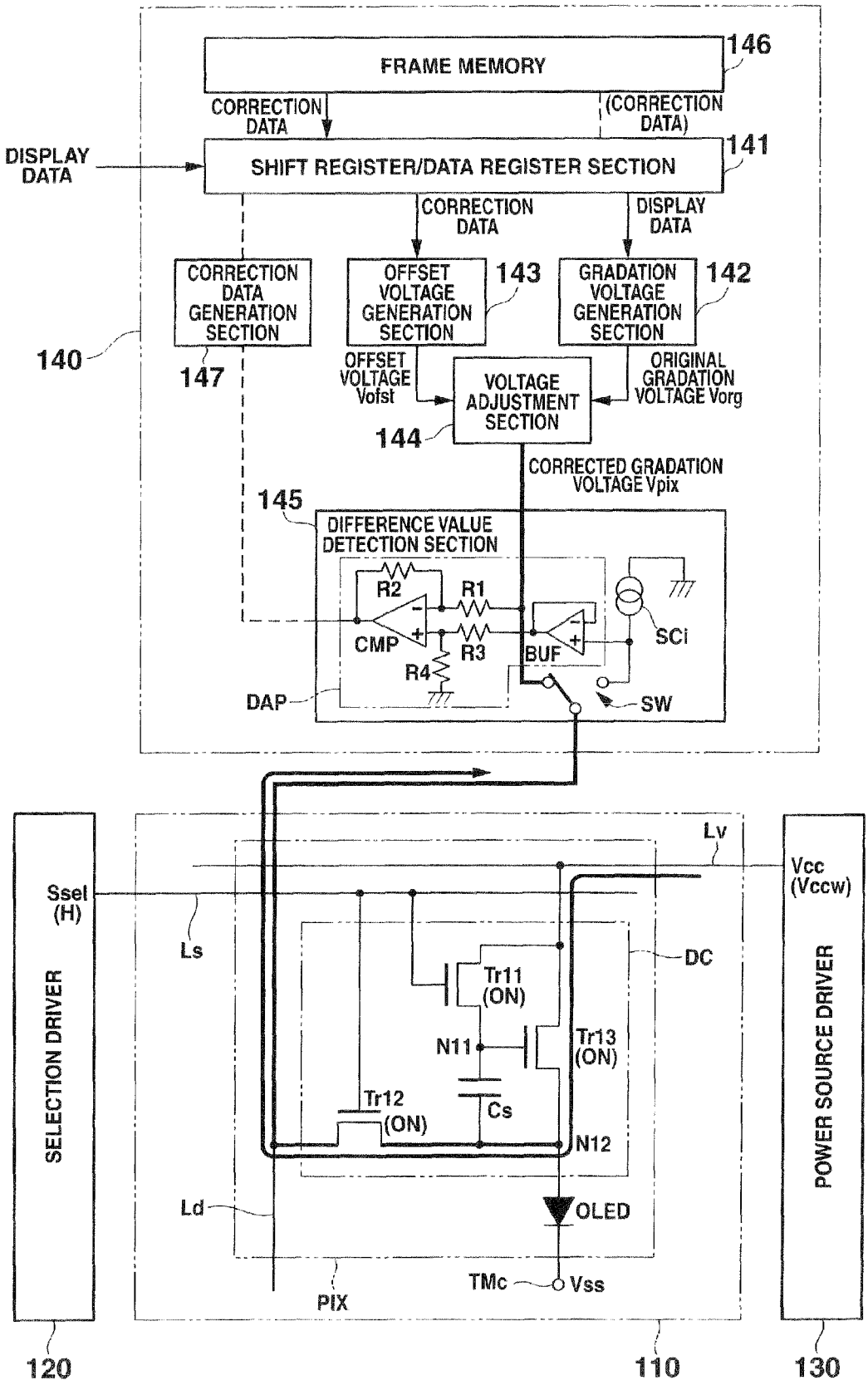
FIG. 15 is a conceptual diagram illustrating a write operation In the display apparatus according to the embodiment.

FIG. 15 is a conceptual diagram illustrating the write operation in the display apparatus according to the embodiment.

Figure 16:
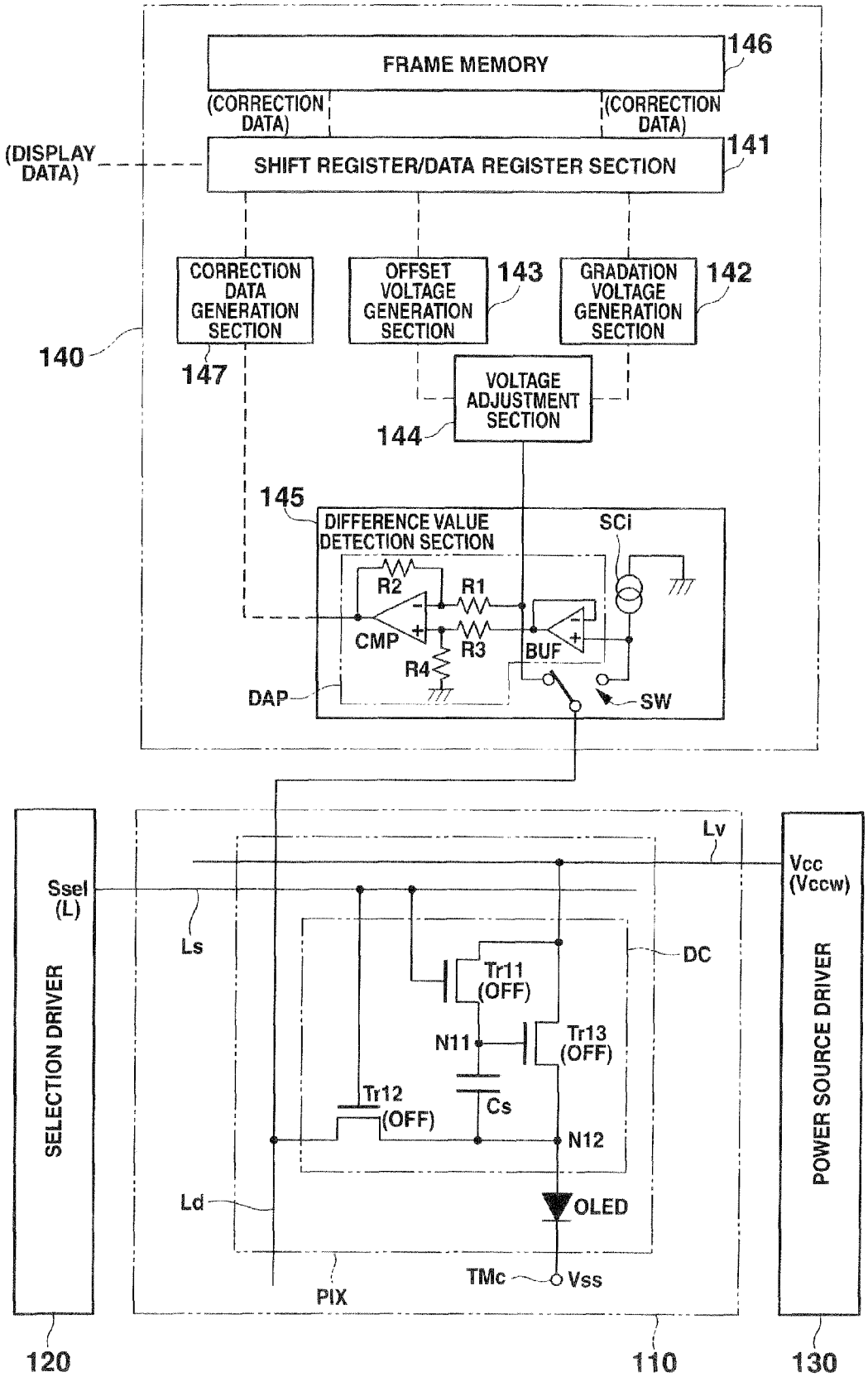
FIG. 16 is a conceptual diagram illustrating a hold operation in the display apparatus according to the embodiment.

FIG. 16 is a conceptual diagram illustrating the hold operation in the display apparatus according to the embodiment.

Figure 17:
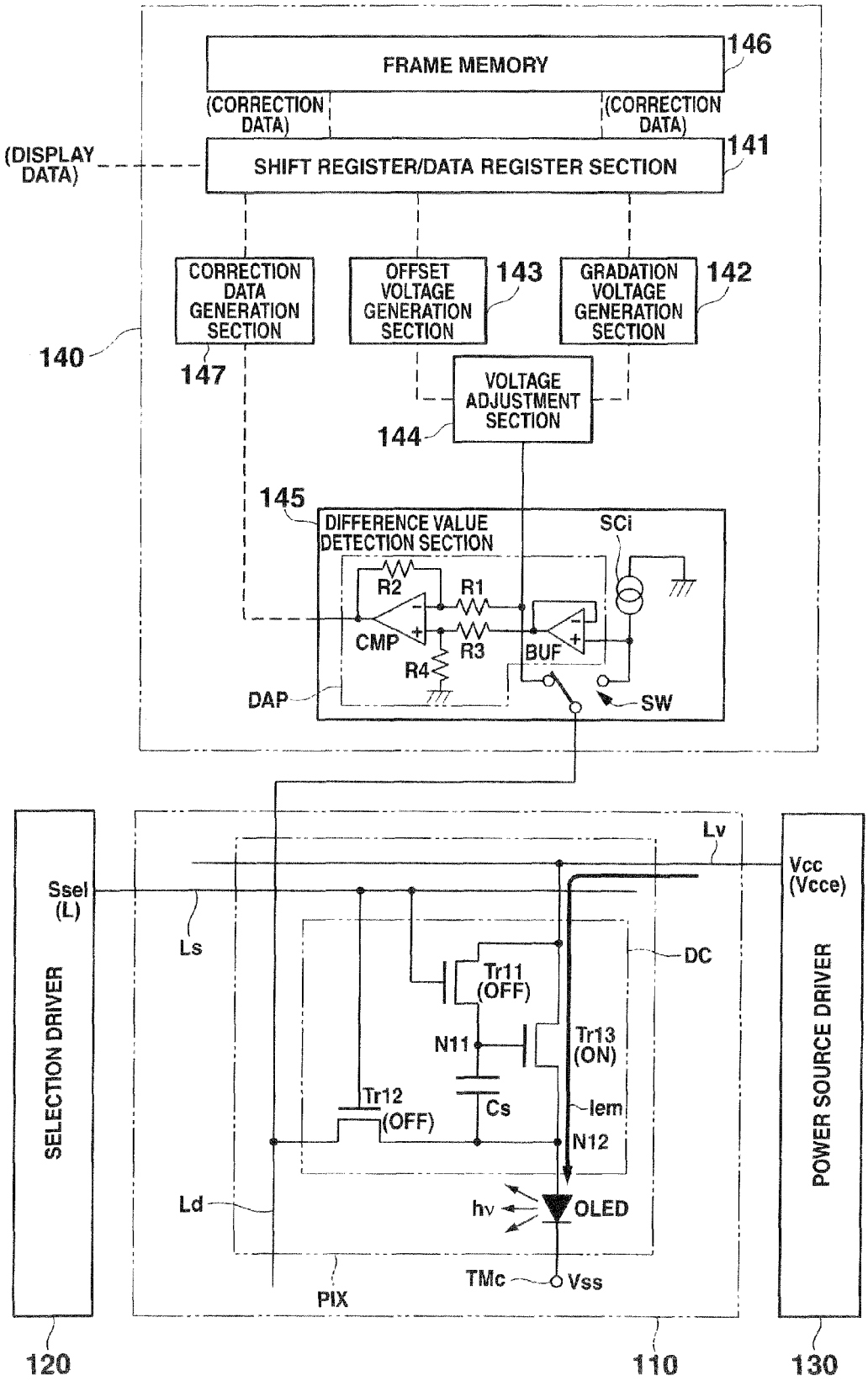
FIG. 17 is a conceptual diagram illustrating a light emission operation in the display apparatus according to the embodiment.

FIG. 17 is a conceptual diagram illustrating the light emission operation in the display apparatus according to the embodiment.

Figure 18:
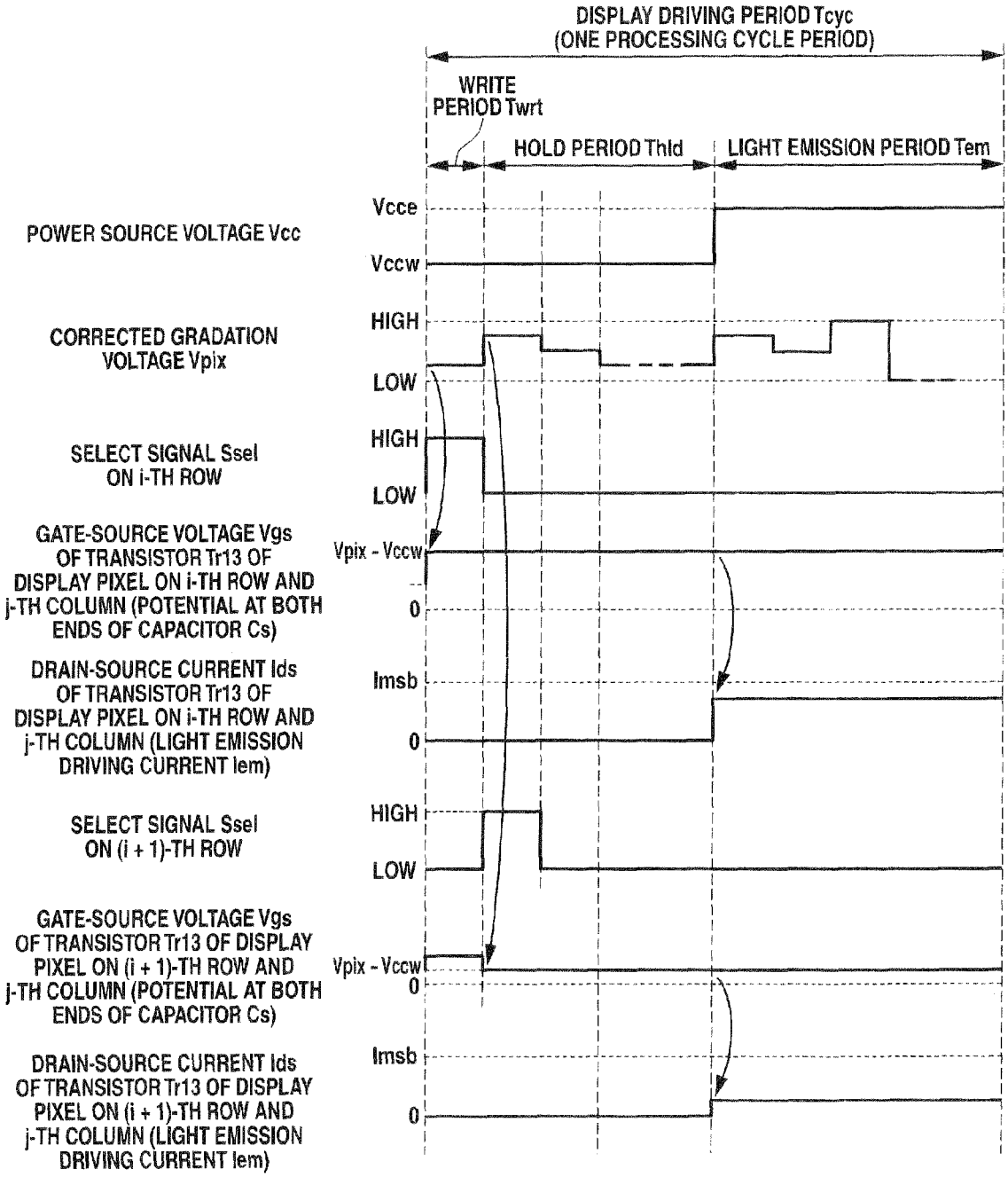
FIG. 18 is a timing chart illustrating one example of the display driving operation in the display apparatus according to the embodiment.

FIG. 18 is a timing chart illustrating the display driving operation in the display apparatus according to the embodiment.

The display driving operation of the display apparatus 100 according to the embodiment (see FIG. 18) is set so that at least the write operation (write period Twrt), the hold operation (hold period Thld) and the light emission operation (light emission period Tem) are executed within the display driving period (one processing cycle) Tcyc (Tcyc≧Twrt+Thld+Tem).

(Write Operation)

In the write operation (write period Twrt), as shown in FIG. 18, the select signal Ssel of selecting level (high level) is applied to the select line Ls on the i-th row and the display pixels PIX on the i-th row are set into the selected state in a state that the power source voltage Vcc (=Vccw≦Vss) of write level (negative voltage) is applied to the power source voltage line Lv on the i-th row. In synchronization with this timing, the corrected gradation voltage Vpix according to the display data is applied to the data line Ld.

In the method of applying the corrected gradation voltage Vpix according to the display data to the data line Ld, as shown in FIG. 14, the luminance gradations of the display pixels PIX to the subject to the write operation are obtained from the display data supplied from the display signal generation circuit 160 (step S411), and a determination is made whether the luminance gradation value is "0" (step S412). When the luminance gradation is "0" in the gradation value determination operation in step S412, a predetermined gradation voltage (black gradation voltage) Vzero for light non-emission operation (or black display operation) is output from the gradation voltage generation section 142. The gradation voltage Vzero is applied directly to the data lines Ld without adding the offset voltage Vofst in the voltage adjustment section 144 (namely, the compensating process is not executed on the fluctuations in the threshold voltages of the transistors Tr12 and Tr13) (step S413).

When the luminance gradation value is not "0" in step S412, the original gradation voltage Vorg having a magnitude according to the luminance gradation is generated from the gradation voltage generation section 142 and is output. The correction data, which are acquired by the correction data acquiring operation and are stored in the frame memory 146 correspondingly to the display pixels PIX, are sequentially read via the shift register/data register section 141 (step S414). The correction data composed of digital signals are output to the offset voltage generation section 143 provided onto the data lines Ld on the respective columns, and are converted into analog signals so that offset voltages Vofst(≈ΔVth) composed of analog voltages according to the variation of the threshold voltages of the transistors Tr13 in the display pixels PIX (pixel driving circuits DC) are generated (step S415).

As shown in FIG. 15, the voltage adjustment section 144 adds the original gradation voltage Vorg of negative potential to be output from the gradation voltage generation section 142 to the offset voltage Vofst of negative potential output from the offset voltage generation section 143, and generates the corrected gradation voltages Vpix of negative potential (step S416). Thereafter, the corrected gradation voltages Vpix are applied to the data lines Ld. The corrected gradation voltages Vpix generated in the voltage adjustment section 144 has a voltage amplitude of comparatively negative potential based on the power source voltage Vcc (=Vccw) of the write operation level (low potential) to be applied from the power source driver 130 to the power source voltage lines Lv. The higher the gradation, the lower the corrected gradation voltage Vpix.

As a result, the corrected gradation voltage Vpix, to which the offset voltage Vofset according to the fluctuation of the threshold voltage Vth of the transistor Tr13 is added and which is corrected, is applied to the source terminal (contact point N12) of the transistor Tr13. For this reason, the corrected voltage Vgs is written and set between the gate and the source of the transistor Tr13 (both ends of the capacitor Cs) (step S417).

In the write period Twrt, the corrected gradation voltage Vpix applied to the contact point N12 at the anode terminal of the organic electroluminescent element OLED is set to be lower than the constant voltage Vss applied to the cathode terminal TMc. For this reason, a current does not flow in the organic electroluminescent element OLED, and light is not emitted therefrom.

(Hold Operation)

In the hold operation (hold period Thld) after the end of the write period Twrt, as shown in FIG. 14, the select signal Ssel of the non-selecting level (low level) is applied to the select line Ls on the i-th row so that the display pixels PIX on the i-th row are set into the non-selected state. As a result, as shown in FIG. 16, the transistors Tr11 and Tr12 are turned off, the diode-connected state of the transistor Tr13 is released, and the capacitor Cs is charged with a voltage component (Vgs=Vpix−Vccw) applied between the gate and the source of the transistor Tr13 so that the voltage component is held.

(Light Emission Operation)

In the light emission operation after the hold period Thld (in the light emission period Tem), as shown in FIG. 18, in a state that the display pixels PIX on the respective rows are set in the non-selected state, the power source voltage Vcc (=Vcce>0V) of high potential (positive voltage) as the light emission level is applied to the power source voltage line Lv on the respective rows. As a result, the transistor Tr13 on each of the display pixels PIX (pixel driving circuit DC) operates in a saturated area. A positive voltage according to the voltage component (|Vpix−Vccw|) written and set between the source and the gate of the transistor Tr13 by the write operation is applied to the anode side (contact point N12) of the organic electroluminescent element OLED. As a result, as shown in FIG. 17, a light emission driving current Iem (the drain-source current Ids of the transistor Tr13) having a magnitude according to the display data (precisely, the corrected gradation voltage Vpix as the corrected gradation voltage) is applied from the power source voltage line Lv to the organic electroluminescent element OLED via the transistor Tr13. As a result, the organic electroluminescent element OLED emits light with predetermined luminance gradation.

The driving operation in the case where the display panel shown in FIG. 9 is applied to the display apparatus according to the embodiment will be specifically described below.

Figure 19:
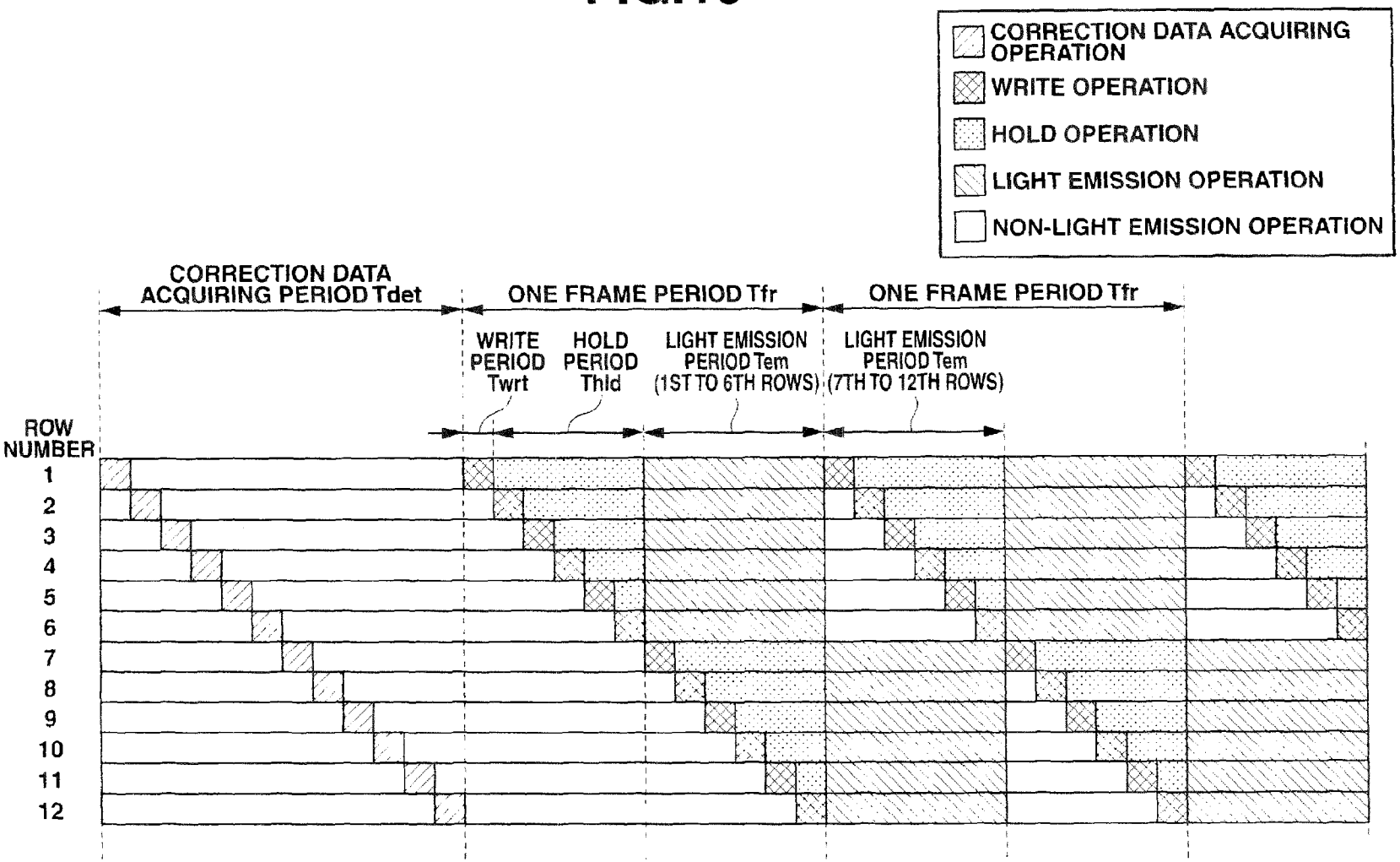
FIG. 19 is an operation timing chart schematically illustrating a specific example of a method for driving the display apparatus according to the embodiment.

FIG. 19 is an operation timing chart schematically illustrating a specific example of a method of driving the display apparatus according to the embodiment.

In FIG. 19, for convenience of the description, 12 rows (n=12; 1st to 12th rows) of display pixels are arranged on the display panel. FIG. 19 is an operation timing chart in the case where the display pixels on the 1st to 6th rows (corresponding to the upper area) and the 7th to 12th rows (corresponding to the lower area) form respective groups.

In the driving operation in the display apparatus 100 having the display panel 110 shown in FIG. 9, as shown in FIG. 19, the correction data acquiring operation is sequentially performed on all the display pixels PIX arranged on the display panel 110 according to the respective rows at predetermined timing. After the end of the correction data acquiring operation on all the rows of the display panel 110 (namely, the end of the correction data acquiring period Tadj), the corrected gradation voltage Vpix is written into the display pixels PIX (pixel driving circuits DC) on the respective rows on the display panel 110 in one frame period Tfr. The corrected gradation voltage Vpix here is obtained by adding the offset voltage Vofst corresponding to the fluctuation of the element characteristic of the drive transistor (transistor Tr13) on the display pixels PIX to the original gradation voltage Vorg corresponding to the display data. The operation for holding a predetermined voltage component (|Vpix−Vccw|) is repeated on the respective rows. During this operation, the display driving operation (the display driving period Tcyc shown in FIG. 14) for allowing all the display pixels PIX included in the group to collectively emit light with luminance gradation according to the display data (corrected gradation voltage Vpix) is repeated on the display pixels PIX on the 1st to 6th rows or the 7th to 12th rows (organic electroluminescent elements OLED) at timing of the end of the write operation. As a result, display information for one screen of the display panel 110 is displayed.

Specifically, the power source voltage Vcc (=Vccw) of low potential is applied to the display pixels PIX in each group via the power source voltage line Lv connected commonly to the display pixels PIX which are arranged on the display panel 110 and in the groups of the 1st to 6th rows and the 7th to 12th rows. In this state, the correction data acquiring operation (correction data acquiring period Tadj) is performed sequentially starting from the display pixels PIX on the first row, and the correction data corresponding to the fluctuation in the threshold voltages of the transistors Tr13 (drive transistors) provided in the pixel driving circuits DC are stored individually in predetermined areas of the frame memory 146 according to the display pixels PIX arranged on the display panel 110.

After the end of the correction data acquiring period Tadj, the power source voltage Vcc (=Vccw) of low potential is applied to the display pixels PIX on the 1st to 6th rows via the power source voltage line Lv connected to these display pixels PIX commonly. In this state, the write operation (write period Twrt) and the hold operation (hold period Thld) are performed sequentially starting from the display pixels PIX on the first row. The power source voltage Vcc (=Vcce) of high potential is applied to the display pixel PIX on the 6th row via the power source voltage line Lv at timing of the end of the write operation. As a result, light is emitted from the display pixels PIX for six rows in this group collectively with luminance gradation based on the display data (corrected gradation voltage Vpix) written into the display pixels PIX. This light emission operation is continued until the timing of the start of the next write operation on the display pixels PIX on the first row (light emission period Tem on the 1st to 6th rows).

At the timing of the end of the write operation on the display pixels PIX on the 1st to 6th rows, the power source voltage Vcc (=Vccw) of low potential is applied to the display pixels PIX on the 7th to 12th rows via the power source voltage line Lv connected commonly to the display pixels PIX in that group. The write operation (write period Twrt) and the hold operation (hold period Thld) are performed sequentially starting from the display pixels PIX on the 7th row. At timing of the end of the write operation on the display pixels PIX on the 12th row, the power source voltage Vcc (=Vcce) of high potential is applied via the power source voltage line LV in that group. As a result, the display pixels PIX on the six rows in this group are allowed to collectively emit light with luminance gradation based on the display data (corrected gradation voltage Vpix) written into the display pixels PIX (light emission period Tem on the 7th to 12th rows). In the period during which the write operation and the hold operation are performed on the display pixels PIX on the 7th to 12th rows, the operation for applying the power source voltage Vcc (=Vcce) of high potential to the display pixels PIX on the 1st to 6th rows via the power source voltage lines Lv and emitting light collectively is continued.

After the correction data acquiring operation is executed on all the display pixels PIX arranged on the display panel 110, the write operation and the hold operation are sequentially performed on the display pixels PIX on each row at predetermined timing. At the time when the write operation on the display pixels PIX on all the rows in a preset group is ended, all the display pixels PIX in this group are allowed to collectively emit light.

Therefore, according to the method (display driving operation) of driving the display apparatus, for a period of one frame period Tfr during which the write operation is performed on display pixels on the respective rows in one group, all the display pixels (light-emitting elements) in this group are not allowed to emit light, so that the display pixels are set to the light non-emission state (black display state). In the operation timing chart shown in FIG. 9, the display pixels PIX on the twelve rows composing the display panel 110 are sorted into two groups, and the light emission operation is performed collectively in respective groups at different timings. For this reason, a percentage (black insertion percentage) of the black display period in the light emission operation for one frame period Tfr can be set to 50%. In order to visually recognize a moving image clearly without blur and oozing, the moving image generally has the black insertion ratio of 30% or more. For this reason, according to this driving method, the display apparatus having comparatively satisfactory display quality can be realized.

The embodiment (FIG. 9) has described the case where the plurality of display pixels PIX arranged on the display panel 110 are sorted into two groups according to continuous rows, but the present invention is not limited to this. The display pixels PIX may be sorted into any number of groups such as three or four groups, and the display pixels PIX on non-continuous rows such as even-numbered or odd-numbered rows may be sorted into groups. As a result, the light emission period and the black display period (black display state) can be set arbitrarily according to the number of groups, so that the display image quality can be improved.

The plurality of display pixels PIX arranged on the display panel 110 are not sorted into groups and the power source voltage lines are disposed (connected) to the display pixels PIX on the respective rows. The power source voltages Vcc are independently applied to the display pixels PIX at different timings, so that the light emission operation may be performed on the display pixels PIX on the respective rows. The common power source voltage Vcc is applied collectively to all the display pixels PIX for one screen arranged on the display panel 110, so that the light emission operation is performed collectively on all the display pixels for one screen on the display panel 110.

According to the display apparatus and the driving method thereof in the embodiment, the corrected gradation voltage Vpix whose magnitude is specified according to the display data and the fluctuation in the element characteristic (threshold voltage) of the drive transistor is applied directly between the gate and the source of the drive transistor (transistor Tr13) for the display data write period. As a result, the predetermined voltage component is held in the capacitor (capacitor Cs), and the light emission driving current Iem flowing in the light-emitting elements (organic electroluminescent elements OLED) is controlled based on the voltage component. As a result, the voltage-specification type (or voltage-application type) gradation control method of emitting light with desired luminance gradation can be applied.

Therefore, even when the display panel is enlarged or highly defined or low gradation display is performed, a gradation signal (corrected gradation voltage) according to the display data can be written into the display pixels more quickly and more securely than the current-specification type gradation control method of supplying a current according to display data so as to perform the write operation (the voltage component according to the display data is held). For this reason, generation of insufficient writing of display data is suppressed, and the light emission operation can be performed with suitable luminance gradation according to the display data, thereby realizing satisfactory display image quality.

Prior to the display driving operation composed of the operation for writing display data into the display pixel (pixel driving circuit) and the hold operation and the light emission operation, the correction data corresponding to the fluctuation in the threshold voltages of the drive transistor provided on the display pixels are acquired. At the time of the write operation, gradation signals (corrected gradation voltages) corrected for the respective display pixels can be generated and applied based on the correction data. For this reason, an influence of the fluctuation in the threshold voltage (shift between the voltage of the drive transistor and the current characteristic) is compensated, and the display pixels (light-emitting elements) can be allowed to emit light with suitable luminance gradation according to the display data. Further, dispersion of the light emission characteristics on the display pixels can be suppressed, and the display image quality can be improved.

According to the display apparatus and the drive control method thereof in the embodiment, the corrected gradation voltage Vpix whose magnitude is corrected according to display data is applied directly between the gate and the source of the drive transistor (transistor Tr13) at the time of the display data write operation according to the fluctuation in the element characteristic (threshold voltage) of the drive transistor. As a result, the predetermined voltage component is held in the capacitor (capacitor Cs), and the light emission driving current Iem flowing in the light-emitting elements (organic electroluminescent elements OLED) is controlled based on the voltage component. As a result, light can be emitted with desired luminance gradation, and satisfactory display image quality can be realized.

Prior to the operation for writing display data into the display pixels (pixel driving circuit), the correction data corresponding to the fluctuation in the threshold voltages of the drive transistors provided on the display pixels are acquired. At the time of the write operation, the gradation signals (corrected gradation voltages) which are corrected for the display pixels based on the correction data can be generated and applied. For this reason, the influence of the fluctuation in the threshold voltage (shift between the voltage of the drive transistor and the current characteristic) is compensated, and the display pixels (light-emitting elements) can be allowed to emit light with suitable luminance gradation according to the display data. As a result, the dispersion of the light emission characteristics on the display pixels can be suppressed, and the display image quality can be improved.

In addition, according to the display apparatus and the drive control method thereof in the embodiment, in the correction data acquiring operation to be performed prior to the write operation, the correction data corresponding to the fluctuation in the threshold voltages of the drive transistors provided on the display pixels can be acquired by a simple control process. For this reason, a processing load on the control section such as the system controller can be decreased, and the operating time necessary for this process can be also decreased.

What is claimed is:

1. A display drive apparatus for driving a display pixel connected to a data line, the display pixel includes a light-emitting element and a drive element in which one end of a current path is connected to the light-emitting element, the display drive apparatus comprising:

a specific value detection section which obtains a specific value corresponding to variation of an element characteristic of the drive element; and a gradation signal correction section which generates a corrected gradation signal by correcting a gradation signal according to display data based on the specific value and applies the corrected gradation signal as a driving signal from one end of the data line to the display pixel, wherein the specific value detection section has a difference value detection section which detects a difference value composed of a value obtained by amplifying, with a preset amplification ratio, a difference voltage between a measured voltage and a standard voltage, said measured voltage is a detected voltage at the one end of the data line when a reference current is allowed to flow in the current path of the drive element on the display pixel via the data line and said standard voltage is corresponding to the magnitude of the reference current, and the specific value detection section obtains the specific value based on the difference value.

2. The display drive apparatus according to claim 1, wherein the difference value detection section has a voltage operating section which has two input terminals including a first input terminal which is applied the measured voltage and a second input terminal which is applied the standard voltage, and obtains the difference voltage between the measured voltage and the standard voltage according to an operation, and outputs a value obtained by amplifying the difference voltage with the amplification ratio as the difference value.

3. The display drive apparatus according to claim 2, wherein the voltage operating section includes a differential amplifier which has the amplification ratio, and the differential amplifier has the two input terminals and an output terminal to output the difference value.

4. The display drive apparatus according to claim 2, wherein the specific value detection section has a correction data generation section which generates a correction data by converting a value into a digital signal, said value is obtained by dividing the difference value output from the voltage operating section by the amplification ratio, and outputs the correction data as the specific value.

5. The display drive apparatus according to claim 4, wherein the gradation signal correction section includes:

a storage circuit which stores the correction data output from the correction data generation section;

a gradation voltage generation section which generates a gradation voltage having a magnitude to allow the light-emitting element to emit light with luminance gradation according to the display data;

an offset voltage generation section which converts the correction data stored in the storage circuit into an offset voltage composed of an analog voltage so as to output it; and a voltage adjustment section which adds the offset voltage output from the offset voltage generation section to the gradation voltage generated by the gradation voltage generation section so as to generate the corrected gradation voltage and output it as the driving signal.

6. The display drive apparatus according to claim 5, wherein the difference value detection section includes:

a current source which outputs the reference current; and a connection path changeover switch which selectively connects an output end of the current source or an output end of the voltage adjustment section to one end of the data line, and when the connection path changeover switch is switched into a side where the output end of the current source is connected to one end of the data line, the reference current is supplied from the current source to one end of the data line, and a potential at the output end of the current source becomes the measured voltage.

7. The display drive apparatus according to claim 1, wherein the standard voltage has a magnitude such that, when the drive element maintains an initial characteristic and the standard voltage is applied to one end of the data line, a current value of a current flowing in the current path of the drive element is equal to a current value of the reference current.

8. The display drive apparatus according to claim 1, wherein the reference current is set to a magnitude necessary for allowing the light-emitting element to emit light with maximum luminance gradation.

9. A display apparatus which displays image information, comprising:

at least one display pixel including a light-emitting element and a drive element in which one end of a current path is connected to the light-emitting element;

at least one data line which is connected to the display pixel; and a data driving section which includes a specific value detection section which obtains a specific value corresponding to variation of an element characteristic of the drive element, and a gradation signal correction section which generates a corrected gradation signal by correcting a gradation signal according to display data based on the specific value so as to apply the corrected gradation signal as a driving signal from one end of the data line to the display pixel, wherein the specific value detection section has a difference value detection section which detects a difference value composed of a value obtained by amplifying, with a preset amplification ratio, a difference voltage between a measured voltage and a standard voltage, said measured voltage is a detected voltage at the one end of the data line when a reference current is allowed to flow in the current path of the drive element on the display pixel via the data line and said standard voltage is corresponding to the magnitude of the reference current, and the specific value detection section obtains the specific value based on the difference value.

10. The display apparatus according to claim 9, further comprising:

a display panel in which a plurality of select lines are arranged in a row direction, said plurality of data lines are arranged in a column direction, said plurality of display pixels are arranged near cross points between said plurality of select lines and said plurality of data lines, respectively; and a selection driving section which sequentially supplies select signals to said each select line and sets the display pixels on the respective rows into a selected state sequentially.

11. The display apparatus according to claim 9, wherein the difference value detection section has a voltage operating section which includes two input terminals including a first input terminal which applied the measured voltage and a second input terminal which applied the standard voltage, and obtains the difference voltage between the measured voltage and the standard voltage according to an operation, and outputs a value obtained by amplifying the difference voltage with the amplification ratio as the difference value.

12. The display apparatus according to claim 11, wherein the specific value detection section has a correction data generation section which generates a correction data by converting a value into a digital signal, said value is obtained by dividing the difference value output from the voltage operating section by the amplification, and outputs the correction data as the specific value.

13. The display apparatus according to claim 12, wherein the gradation signal correction section includes:

a storage circuit which stores the correction data output from the correction data generation section;

a gradation voltage generation section which generates a gradation voltage having a magnitude to allow the light-emitting element to emit light with luminance gradation according to the display data;

an offset voltage generation section which converts the correction data stored in the storage circuit into an offset voltage compose of an analog voltage so as to output it; and a voltage adjustment section which adds the offset voltage output from the offset voltage generation section to the gradation voltage generated by the gradation voltage generation section so as to generate the corrected gradation voltage and output it as the driving signal.

14. The display apparatus according to claim 13, wherein the difference value detection section includes:

a current source which outputs the reference current; and a connection path changeover switch which selectively connects an output end of the current source or an output end of the voltage adjustment section to one end of the data line, and when the connection path changeover switch is switched into a side where the output end of the current source is connected to one end of the data line, the reference current is supplied from the current source to one end of the data line, and a potential at the output end of the current source becomes the measured voltage.

15. The display apparatus according to claim 9, wherein the standard voltage has a magnitude such that, when the drive element maintains an initial characteristic and the standard voltage is applied to one end of the data line, a current value of a current flowing in the current path of the drive element is equal to a current value of the reference current.

16. A drive control method for a display apparatus for displaying image information, the display apparatus including at least one display pixel including a light-emitting element and a drive element in which one end of a current path is connected to the light-emitting element, the method comprising:

a step of supplying a reference current to the display pixel via a data line connected to the display pixel;

a step of detecting a difference value obtained by amplifying, with a preset amplification ratio, a difference voltage between a measured voltage detected at one end of the data line and a standard voltage, said standard voltage is corresponding to a magnitude of the reference current;

a step of obtaining a specific value corresponding to a variation of an element characteristic of the drive element based on the difference value; and a step of generating a corrected gradation signal by correcting a gradation signal according to display data based on the specific value so as to apply the corrected gradation signal as a driving signal from one end of the data line to the display pixel.

17. The drive control method according to claim 16, wherein at the step of obtaining the specific value includes:

a step of obtaining a value by dividing the difference value by the amplification ratio, and generating a correction data as the specific value by converting the value into a digital signal.

18. The drive control method according to claim 17, wherein the step of supplying the driving signal to the display pixel includes:

a step of storing the correction data in a storage circuit;

a step of generating a gradation voltage having a magnitude to allow the light-emitting element to emit light with luminance gradation according to the display data;

a step of reading the correction data stored in the storage circuit and converting the correction data into an offset voltage composed of an analog voltage so as to output it; and a step of adding the offset voltage to the generated gradation voltage so as to generate the corrected gradation voltage, and applying the corrected gradation voltage as the driving signal to one end of the data line.

19. The drive control method according to claim 16, wherein the standard voltage has a magnitude such that, when the drive element maintains an initial characteristic and the standard voltage is applied to one end of the data line, a current value of a current flowing in the current path of the drive element is equal to the reference current.

* * * * *